US005906233A

United States Patent [19]

May

[11] Patent Number: 5,906,233

[45] Date of Patent: May 25, 1999

[54] SAFETY DEVICE AND SYSTEM FOR WINDOW COVERING PULL CORDS

[76] Inventor: Vincent Lee May, 20057 Kenosha, Harper Woods, Mich. 48225

[21] Appl. No.: 08/972,286

[22] Filed: Nov. 18, 1997

Related U.S. Application Data

[60] Provisional application No. 60/031,433, Nov. 20, 1996.

[51] Int. Cl.[6] ..... E06B 9/38

[52] U.S. Cl. ..... 160/178.1 R; 24/115 F

[58] Field of Search ..... 160/178.1 R, 173 R, 160/178.2 R, 320, 321, 168.1 R, 176.1 R, 177 R; 24/115 F; 16/114 B, 121, 122

[56] References Cited

U.S. PATENT DOCUMENTS

| | | | |
|---|---|---|---|
| 3,485,285 | 12/1969 | Anderle . | |
| 3,727,665 | 4/1973 | Debs . | |
| 4,635,698 | 1/1987 | Anderson . | |
| 4,909,298 | 3/1990 | Langhart et al . | |
| 5,473,797 | 12/1995 | Wu . | |
| 5,504,977 | 4/1996 | Weppner et al . | |
| 5,560,414 | 10/1996 | Judkins et al. | 160/178.1 R |
| 5,562,140 | 10/1996 | Biba | 160/178.1 R |
| 5,592,983 | 1/1997 | Sartini et al . | |
| 5,715,884 | 2/1998 | Cotten | 160/178.1 R |
| 5,735,329 | 4/1998 | Akins et al. | 160/178.1 R |

OTHER PUBLICATIONS

Advertisement of Break–Thru Corp., a subsidiary of Hunter–Douglas Trademark "Break–Thru".

*Primary Examiner*—David M. Purol

*Attorney, Agent, or Firm*—Reising, Ethington, Barnes, Kisselle, Learman & McCulloch, P.C.

[57] ABSTRACT

Disclosed are improved horizontal venetian blind safety pull cord rigging systems and several embodiments of improved break-open safety pull cord tassels for detachably intercoupling two or more manipulating runs of Venetian blind hoisting halyards. A safe single pull cord is suspended in an improved manner from the lowest tassel used in the rigging array. Either the tassel(s) or a slack preventer on each halyard run engages the frame rail, or halyard lock mechanism therein, when the blind is lowered the desired maximum amount so that insufficient slack then remains in the blind-slat-entrained halyard runs to form a strangulation loop by slack pull-out. Two or three break-open safety tassels are arrayed and rigged to handle three and four halyard cord blinds. The "high level" safety tassel can thus also serve as a safe equalizer as well as insuring level blind operation.

39 Claims, 14 Drawing Sheets

1 Lower blind completely, then raise approx. 2 inches. Keep botton rail level.
2 Remove any clips holding cords together.
3 Cut cord just above old tassel. (Illus. A) If no tassel exists, cut cord at bottom of loop. (Illus. B)

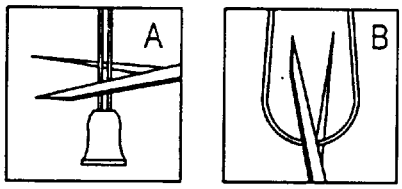

(Prior Art)

FIG. 2B

4 Assembly for blinds with 2 cords: Slip one cord through each hole in each half of Break-Thru. (Illus. C) Tie knot at bottom of each cord. Pull each half of Break-Thru snug against knot. Be sure the two Break-Thru halves are at the same height.

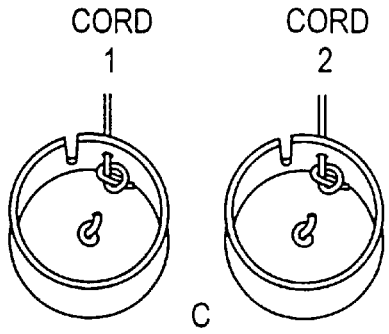

(Prior Art)

FIG. 2C

5 Assembly for blinds with 3 or 4 cords: Use Illus. D as a guide. Attach the two cords coming from the front of the headrail to the same half of the Safely Tassel. Slip Cord 1 cord through the hole, Cord 3 slips into the slot. Tie knot at bottom of each. Attach Cord 2 and 4 to the other half of the tassel in the same manner. Be sure the two Break-Thru halves are at the same height.

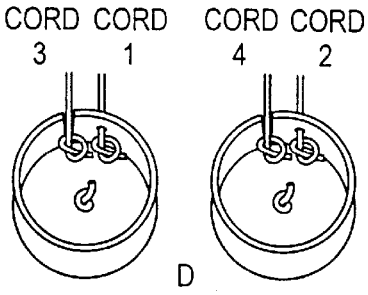

CAUTION: 3 and 4 cord applications present special problems of cord twisting which can sometimes prevent the Safely Tassel from operating as intended. Please see warning on side of this package.

6 Press the two halves of the Break-Thru Safety Tassel together.

(Prior Art)

FIG.2D

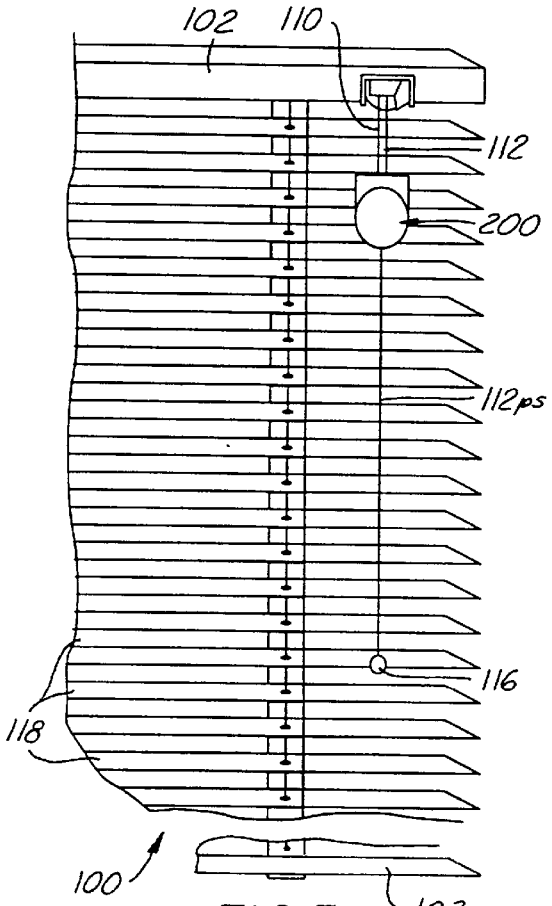

FIG.3

SAFETY DEVICE AND SYSTEM FOR WINDOW COVERING PULL CORDS

This application claims the benefit under 35 U.S.C. §119(e) of U.S. Provisional application Ser. No. 60/031,433, filed Nov. 20, 1996, and the benefit of Disclosure Documents No. 380,499 and No. 383,939.

FIELD OF THE INVENTION

This invention relates to safety devices and systems for cords for window coverings. More particularly, the invention relates to safety devices which are useful with a plurality of cords for raising, lowering and equalizing venetian blind window coverings to prevent infants from strangling when the infants press their heads downwardly between loops in the cords.

BACKGROUND OF THE INVENTION

Window cords are coupled to vertical drop window coverings to provide for adjustments in the vertical portions of the windows shielded by such coverings. The cords often extend downwardly to a position slightly above floor height or to a position at floor height, although they may sometimes be disposed as high as several feet above floor height. Such adjustments are typically made by manipulating cords, chains, strings or equivalent flexible tension elements. In a typical window horizontal venetian blind, for instance, the position of the blind over a window and the orientation of light control blades are set by pulling or relaxing cords coupled to the blinds through pulleys in the frame headrail of the blind unit. Such adjustments generally require pulling or relaxing simultaneously an array of a plurality of cords, the cords most often being arrayed in pairs but also in triple and quadruple arrays. For convenience in making such adjustments such cords have traditionally been coupled by a pull tassel in a continuous loop suspended from the headrail.

One problem existing with such conventional venetian blind assemblies is that one lift cord may be moved relative to adjacent lift cord so that the slats of the blind will be raised or lowered in an unequal or skewed manner. This results in an unattractive appearance of the blind assembly. Accordingly, lift cords of conventional blind assemblies have been knotted together in an attempt to assure that the cords will move evenly together to obtain even lifting or lowering of the slats. The knot, however, presents an unattractive appearance and, unless securely knotted, may allow slippage of one cord with respect to the adjacent cord. Alternatively, a cord equalizer also has been provided, in addition to a pull tassel, in order to securely lock adjacent cords together to prevent relative slippage between the cords as to assure even raising or lowering of the slats of a blind assembly. Preferably these cord equalizer devices are designed to be unobtrusive and present a small structure which will not distract from the cord configurations.

However, such tassels and equalizers for pull cords for window coverings, such as drapes, blinds or the like, potentially can be dangerous for small children. If the cords are so connected together to form a continuous loop, the cords can act as a noose for a small child if the child's head or other body part gets caught between them. This problem is particularly acute if adults fail to properly secure the cords on the window or door frame and allow them to dangle near the floor, or an infant crib.

These window cords present an attractive but hazardous invitation to infants to play with such cords. The infants are fascinated by the cords, particularly since the cords move when touched. However, many parents do not appreciate the dangers presented by the dangling cords, or when they do, may tie, clip or cleat the cords to shorten the cords. Nevertheless, even aware parents are sometimes negligent in adjusting the height of the cord after they have adjusted the position of the window covering.

As a result of these problems resulting from dangling cords many children die annually from strangulation by playing with such cords. In addition, a considerable number of children probably become injured every year by playing with such cords but such injuries are not reported.

Nevertheless, the available statistical information indicates that an average of one child per month is strangled needlessly by pull cord window coverings, and 86% of these deaths occurred in horizontal venetian blinds (ref: Journal American Medical Association Jun. 4, 1997-vol 277, No. 21). In response to this tragic statistic many of the manufacturers of blinds have in recent years redesigned the pull cord system to reduce the rate of fatalities. The equalizer has been removed altogether. The pull cord loop has been cut and a tassel has been placed on each string, or some type of breakaway safety tassel has been provided. These methods helped to increase child safety but reduced the quality of the blind by making it harder to equalize. Presently, the standard is to cut the cord and put tassels at the end of each cord and place the excess cord slack out of reach of the child whenever the blind is used. If the cords were placed out of reach of children at all times this could possibly solve most of the cord strangulations. However, such solutions leave much to be desired, and none of these solutions address the issue of cord slack pulled between the blinds when the blind is completely lowered. Of course, for user convenience, the need for an equalizer, albeit dangerous, also still remains.

As indicated above, the window coverings industry is generally moving away from such looped cords due to the hazards they present, particularly for small children who may inadvertently become entangled in the pull-tassel-coupled cord loop. As a result, a number of alternatives are being explored for releasably attaching the cord ends together, thereby permitting simultaneous manipulation of the cords, while allowing the cords to be separated when a force is exerted between them. One prior art solution to this pull-tassel cord coupling problem is found in U.S. Pat. No. 4,909,298 (incorporated herein by reference) in which two pull cords are coupled to a tassel device that has two discrete and separable mating halves and in which each half is connected in a fixed relationship to one of the pull cords. The separate mating elements are then releasably clipped or snapped into engagement with one another to join the cords. When a separating force is exerted between the elements, the elements snap apart, freeing the cords from one another and thus opening the loop. A variety of other releasable pull cord coupling devices have also been proposed, such as in the prior art or contemporaneous U.S. Pat. Nos. 5,473,797; 5,504,977 and 5,592,983 (each also being incorporated herein by reference).

Although such pull-tassel devices may generally be effective in releasably securing the cords together, many do not offer a particularly aesthetic solution to the problem, and others do not lend themselves well to known mass production techniques. Accordingly, despite such innovations in the art, there remains a need for a reliable safety tassel device having a pleasing appearance and, at the same time, a relatively simple structure that can be readily mass produced at a reasonable cost. In particular, there is a need for such a device that can effectively hold at least two cords for simultaneous manipulation and reliably release or separate the cords in response to a separating force exerted between them. In addition, the criteria of aesthetics and cost are particularly important in the competitive field of window coverings, in which purchasing decisions of designers, architects and users may turn on such factors, given solutions of comparable practical utility.

Moreover, there is an overriding and hitherto unmet need for such a safety pull-tassel system that can also solve the problem of a strangulation noose being formed when cord slack is pulled out from between the blinds when lowered, as well as the unmet need to solve the problem of safely equalizing the pull exerted by an array of plural pull cords.

OBJECTS OF THE INVENTION

Accordingly, among the objects of the invention are to provide improved window-covering pull cord safety tassel devices and cord coupling safety systems that overcome all of the aforementioned problems and satisfy all of the aforementioned needs in an economical and reliable manner and that also satisfy the aforementioned industry manufacturing and marketing criteria for such devices and systems.

BRIEF DESCRIPTION OF THE DRAWINGS

The foregoing as well as other objects, features and advantages of the present invention will become apparent from the following detailed description of the best mode presently known to the inventor of making and using the invention, when taken in conjunction with the appended claims and the accompanying drawings in which:

FIG. 3 illustrates a first embodiment of an improved venetian blind pull cord and equalizer safety system of the invention utilizing an improved first or second embodiment safety tassel of the invention and with the blinds illustrated in their fully lowered condition;

DESCRIPTION AND ILLUSTRATION OF PRIOR ART PROBLEMS AND DEVICES

Figure 1:
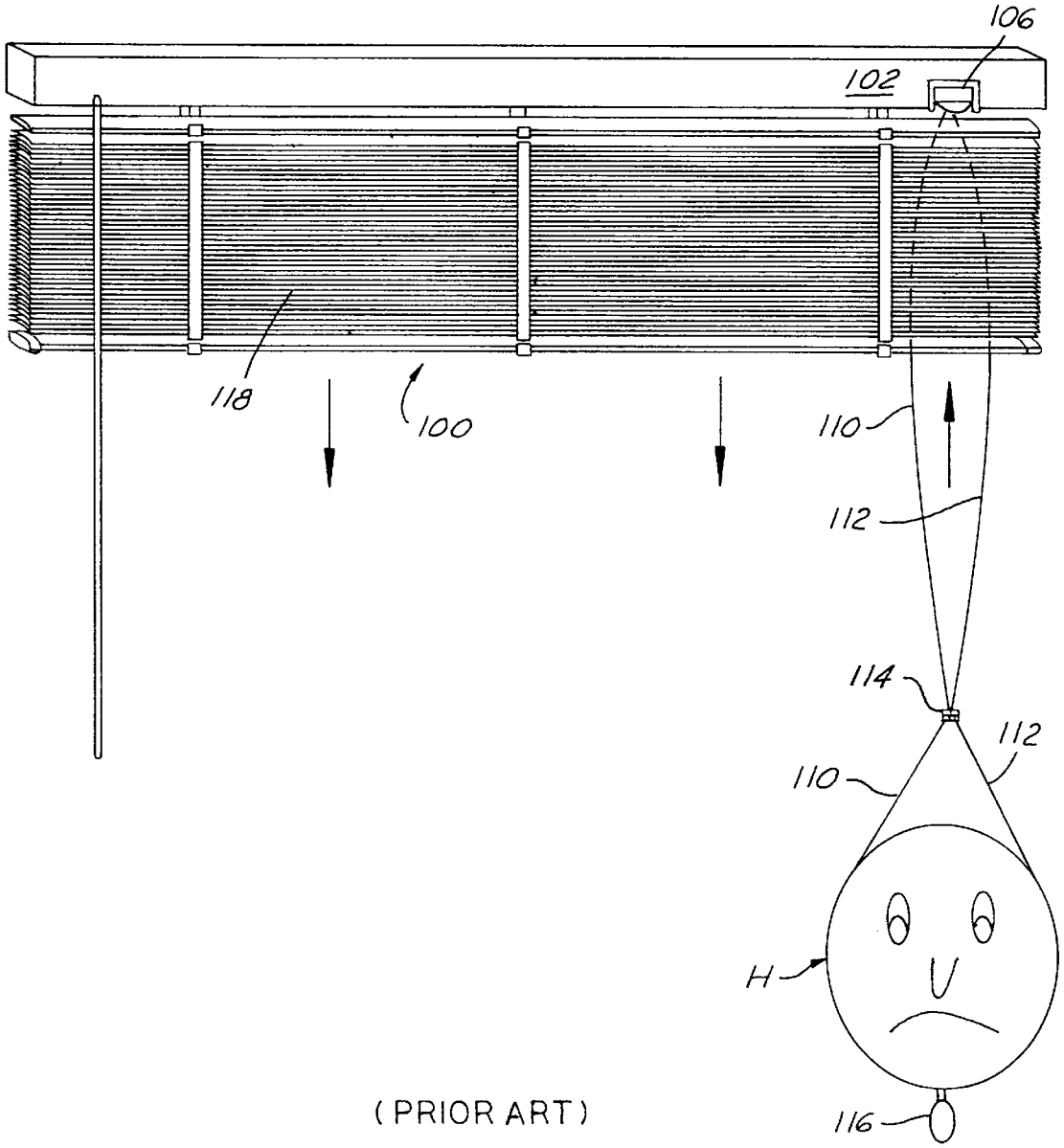
(PRIOR ART) FIG. 1
FIG. 1 of a diagrammatic elevational view of a typical prior art installation of a horizontal venetian blind assembly hoisted fully up and utilizing a dual-halyard pull cord set-up provided with both a conventional equalizer clip and a conventional pull cord coupling tassel by which the lower most ends of the cords are interconnected, one of the three or more strangulation hazards of this set-up being diagrammatically illustrated by the symbol of an infant's head caught in the lower loop of the blind-exterior hanging pull cords.

FIG. 1 shows one of the hazards with the pull cord strings 110 and 112 equipped and arranged as in the prior art. For example, with the blind 100 hoisted full up, the danger occurs as when a head H of a child gets tangled in the strings 100 and 112, causing the cord lock ball 106 to drop. This action releases the blind slats 118, thereby pulling the pull cord strings 110 and 112 upward. Essentially, the blind 100 acts like a gallows resulting in a possible hanging. The danger exists anywhere between the non-break-apart tassel 116 and non-break-apart equalizer 114, and between the equalizer top to the head rail 102.

Figure 2A:
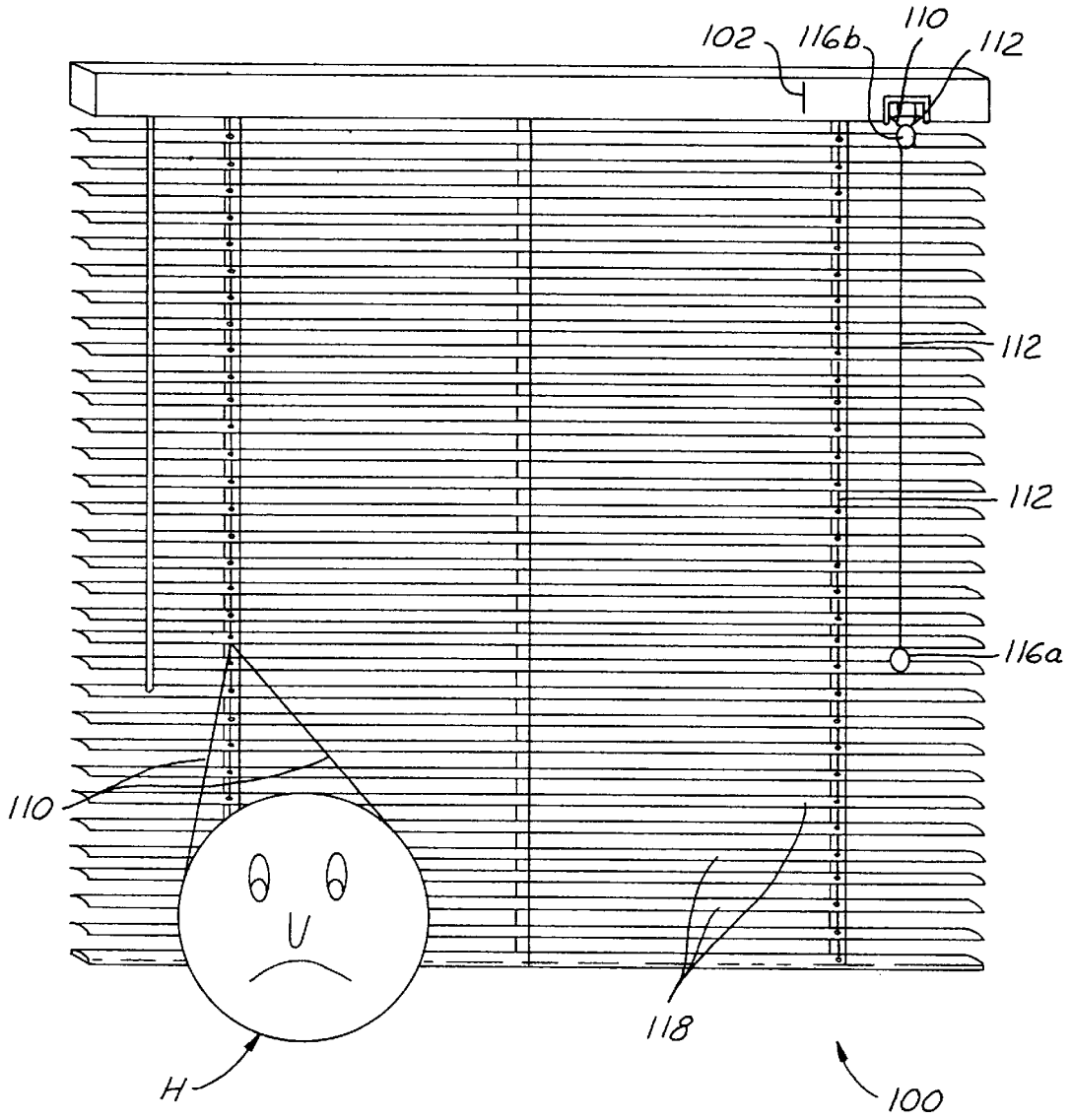
( PRIOR ART ) FIG. 2A
FIG. 2 is an illustration of the venetian blind set up of FIG. 1A with the blinds fully lowered to provide the usual slack in the pull cord blind halyard system, with the blind-slat-entrained downrun of the left hand halyard pulled out to form another strangulation loop as diagrammatically illustrated by the infant head symbol entrained in such slack loop.
FIGS. 2B, 2C and 2D are reproductions of the packaging instructions and illustrations accompanying a prior art commercially available safety tassel sold under the trademark "BREAK-THRU" by BREAK-THRU CORPORATION, a subsidiary of HUNTER DOUGLAS, INC. of Upper Saddle River, N.J.

FIG. 2A demonstrates the conditions for the cord slack safety hazard of another prior art arrangement with the equalizer 114 removed (as now required). Conventional one-piece tassels 116*a* and 116*b* are respectively attached to pull cord strings 112 and 110. The cord slack hazard occurs when blind 100 is completely down and lock ball 106 is not latched. The strings 110 and/or 112 can be pulled out from slats 118 as demonstrated by string 110. A child could be tangled and/or hung by this slack string 110, as shown diagrammatically in FIG. 2A.

FIGS. 2B, 2C and 2D are a copy of package instructions that illustrate and describe the installation of pull cords in a commercially available prior art "BREAK THRU"™ safety tassel for blinds equipped with two, three or four pull cords.

This and other commercial safety tassels are installed in place of the tassel 116 in FIG. 1, with equalizer 114 removed. Hence the head of H of a child caught as in FIG. 1 would cause the "BREAK THRU" safety tassel to separate and free the child from the pull cords. However, the cord slack safety hazard of FIG. 2A is still present in such a prior art installation.

Description Of The Preferred Embodiments Of The Invention

First Embodiment Safety Pull Cord System

FIG. 3 shows the first embodiment improved safety tassel (I.S.T.) 200 (described hereinafter) that has been moved to an equalizer position to thereby set up the first embodiment safety pull cord system of the invention. To equalize the blind 100 the tassel (I.S.T.) 200 is installed 2" below the conventional frame head rail 102 of the blind assembly when the bottom rail 103 is completely down and level. The system also features a single string pull cord 112ps that is located and attached at the middle bottom of (I.S.T.) 200, and that carries the one-piece tassel 116 that now is used to adjust height of the slats 118. When the pull string 112ps is pulled, equal tension on both strings 110 and 112 is applied via (I.S.T.) 200 to which the lower ends of strings 110 and 112 are attached. This forms a couple on (I.S.T.) 200, thereby insuring the user a level blind pull while at the same time preventing both hazards shown in FIGS. 1 and 2A (as described in more detail hereinafter).

First Embodiment Safety Tassel

The first embodiment safety tassel 200 as shown in FIGS. 4A–5C and in accordance with the invention is a modification and improvement upon the Break-Thru safety tassel of FIGS. 2B–2D. Thus the two separable parts 202 and 204 of tassel 200 may be duplicates of the corresponding tassel parts shown in FIGS. 2C and 2D. As a modification addition to parts 202 and 204, an inclined ramp 206 is suitably attached and affixed to part 202, and likewise a like ramp 208 to part 204.

Figure 4A:
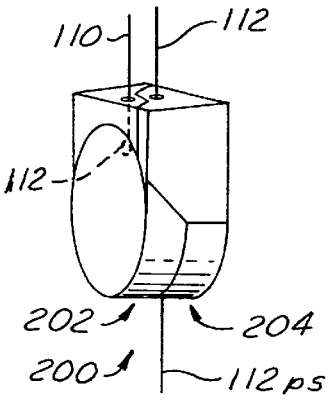
FIG. 4A is a simplified perspective view of the first embodiment safety tassel in assembly
Figure 4B:
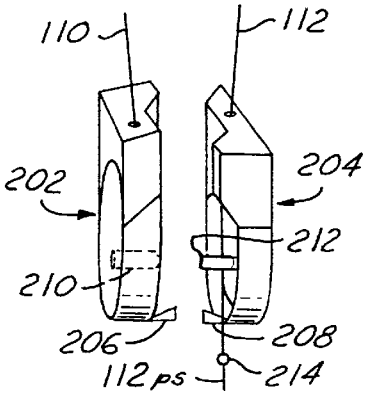
FIG. 4B is a simplified perspective view of the tassel of FIG. 4A with the two tassel members shown separated.
Figure 4C:
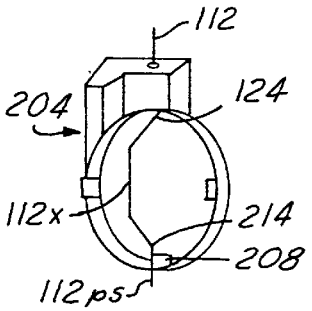
FIG. 4C is a simplified perspective view looking at the interior of the right hand piece of FIG. 4B.
Figure 4D:
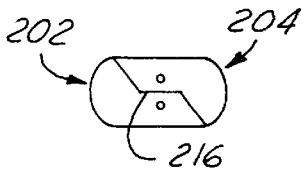
FIG. 4D is a simplified top plan view of the assembly of FIG. 4A.
Figure 4E:
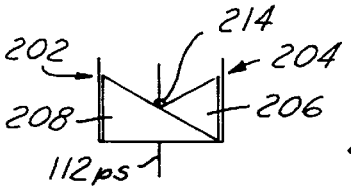
FIG. 4E is a fragmentary semi-diagrammatic view on an enlarged scale illustrating the laterally overlapping ramps of the tassel of FIGS. 4A–4D when fully closed.

FIG. 4E is a view of ramps 206 and 208 when pieces 202 and 204 are closed as in FIG. 4A with single lower pull string 112ps and associated pull string knot 214 installed as shown in FIGS, 4A and 4C, and described in more detail hereinafter with reference to FIGS. 14, 13A and 15B.

Figure 4F:
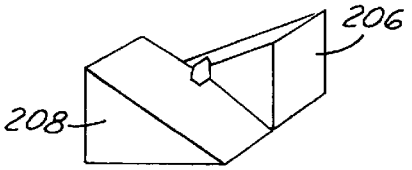
FIG. 4F is a perspective view of the two ramps shown by themselves and enlarged over the scale of FIG. 4E.

FIG. 4F illustrates the design of the ramps 206 and 208 and their side-by-side relationship in tassel closed position.

The improved safety tassel (I.S.T.) 200 thus uses the two identically molded pieces 202 and 204 shown in FIG. 4A (and in FIGS. 2C and 2D). As modified there are two types of "clipping" devices on tassel 200. The first one is the pre-existing post 212 and socket 210 seen in FIG. 4B. Post 212 slides into the socket 210 with a releasable friction fit. The purpose of this coupling joint is to hold the pieces 202 and 204 together when (I.S.T) 200 is not being used and hence at rest.

The second "clipping device" is an add-on modification, namely, the inverted ramps 206 and 208 in FIG. 4E as used with a wedge means, i.e., a pull string knot 214, resting slidably on and wedged between the ramps 206 and 208 where imaginary extension planes of their oppositely inclined upper surfaces intersect. When pull string 112ps is pulled, the pull string knot 214 tends to push the ramps 206 and 208 "outward", i.e., respectively toward the left and right as viewed in FIGS. 4E and 4F. Since ramp 206 is attached only to piece 202 and ramp 208 only to piece 204, this causes the pieces 202 and 204 to compress, thereby holding them together with a coupling force directly proportional to the down pull force exerted on pull string 112ps.

FIG. 4C shows the pull string flexible interconnector slack 112x. Its purpose is to prevent the pull string knot 214 from interfering with the leveling knot 124 while keeping strings 112 and 112ps always interconnected. The leveling knots 122 and 124 in FIGS. 4A and 4C are used to level tassel 200 with the blind 100 as described in FIGS. 2B–2D.

Figure 5A:
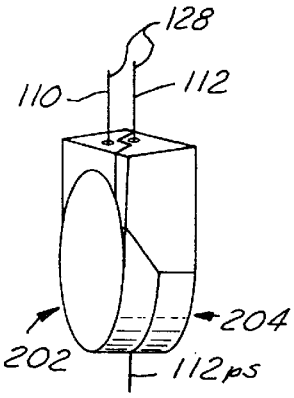
FIGS. 5A, 5B and 5C illustrate in sequence the break apart operation of the safety tassel of FIGS. 4A–4F.
Figure 5B:
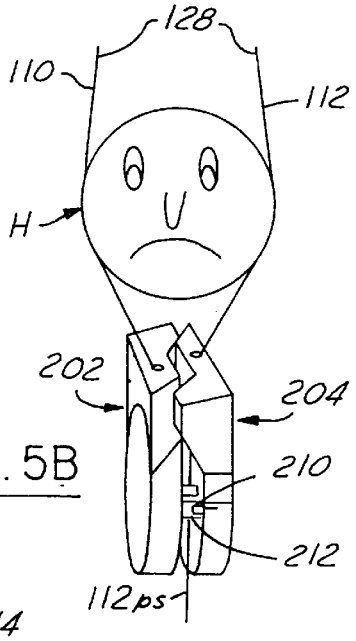
Figure 5D:
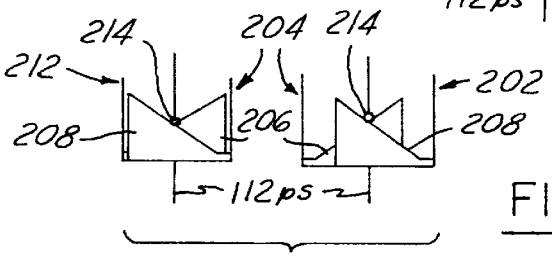
FIG. 5D is a composite semi-diagrammatic view in cross-section, similar to FIG. 4E, but illustrating the motion of the ramps as the tassel moves from the fully coupled closed condition of FIG. 5A to the partially separated condition of FIG. 5B.
Figure 5C:
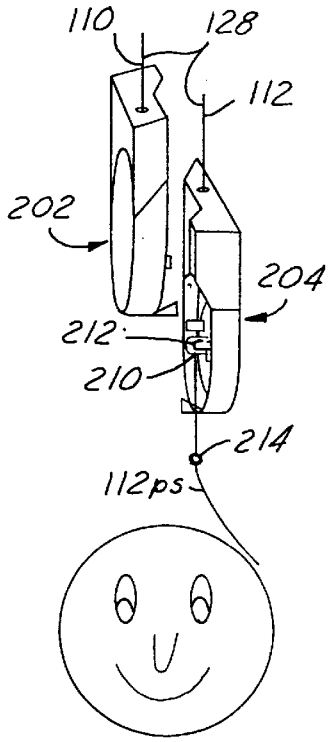

FIGS. 5A–5D demonstrates how the pull cord hazard illustrated in FIG. 1A is prevented. As loop 128 (formed by strings 110 and 112 as coupled by tassel 200) begins to separate in response to the forces created by impingement with child head H, post 212 and socket 210 pull apart as shown in FIG. 5B. FIG. 5D shows how, as this is occurring, the pull string knot 214 is being pushed up the ramps 206 and 208 until the knot 214 is freed by separation of the pieces. As a result, this uncoupling of pieces 202 and 204 has decoupled the strings and thereby released the head of the child from between the strings 110 and 112 as shown in FIG. 5C.

Second Embodiment Safety Tassel

FIGS. 6A–7C illustrate a second embodiment of tassel 200 wherein only the ramps and wedge means are changed.

Figure 6A:
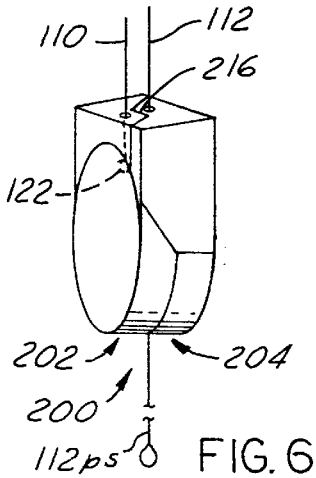
FIGS. 6A, 6B and 6C correspond to FIGS. 4A, 4B and 4C respectively, but illustrate a modified ramp wedge provided in a second embodiment of a safety tassel of the invention.
Figure 6B:
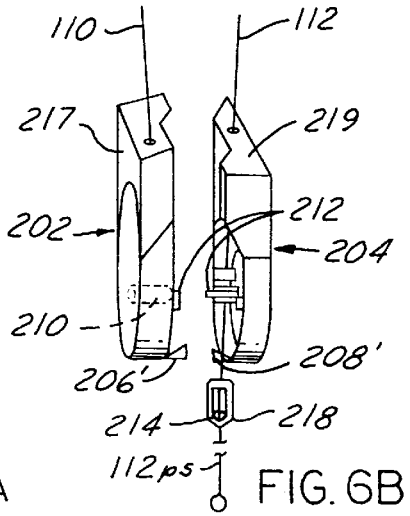
Figure 6C:
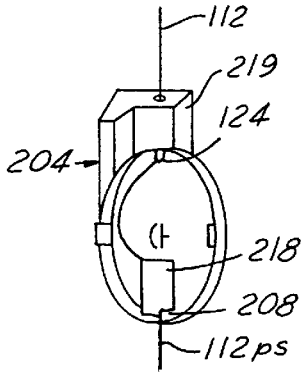
Figure 6F:
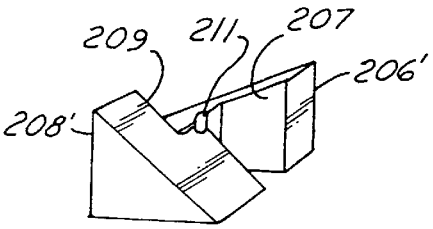
FIG. 6F corresponds to FIG. 4F but shows the modified ramps employed in the second embodiment safety tassel.
Figure 7A:
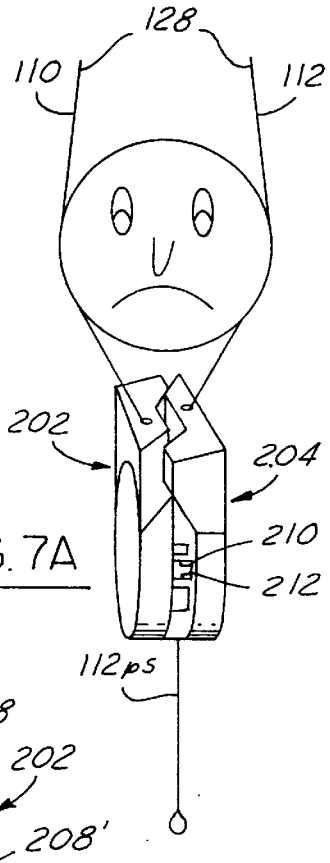
FIGS. 7A and 7B are sequential views corresponding to FIGS. 5B and 5C, but illustrating the operation of the second embodiment safety tassel.
Figure 7C:
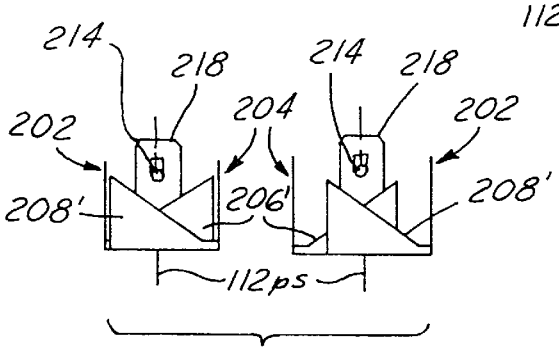
FIG. 7C corresponds to FIG. 5D, but illustrates the operation of The modified ramp wedge and ramps of the second embodiment safety tassel of FIGS. 6A–7B.

FIG. 7C shows the modified ramps 206' and 208' and the associated modified ramp wedge 218 when the pieces 202 and 204 are closed (left hand view) and being separated (right hand view). FIG. 6F shows the modified ramps 206' and 208' by themselves in the closed position.

The ramp wedge 218 is used to allow for easier assembly of the improved safety tassel (I.S.T.) 200 or pieces 202 and 204 when loop 128 is broken apart. The ramp wedge 218 does this by providing more surface area in contact between the pull string knot 214 and the ramps 206' and 208' than the knot alone as in FIG. 4D. This span of ramp wedge 218 over both of the inclined surfaces of ramps 206' and 208' allows room for a slotted area in the modified ramp design 206' and 208' shown in FIG. 6F. The cut away slots 207 and 209 respectively on ramps 206' and 208' allow the pull string 112ps to slide between the ramps 206' and 208' when the pieces 202 and 204 are being assembled. A narrow control slot 211 is also provided for pass through of cord 112ps in the fully closed condition of the modified tassel 200. It is to be understood that ramps 206' and 208' as respectively fixed to pieces 202 and 204 are held closely laterally spaced apart by such fixation.

FIG. 7C illustrates the motion of the modified ramps 206' and 208' with the ramp wedge 218.

Figure 7B:
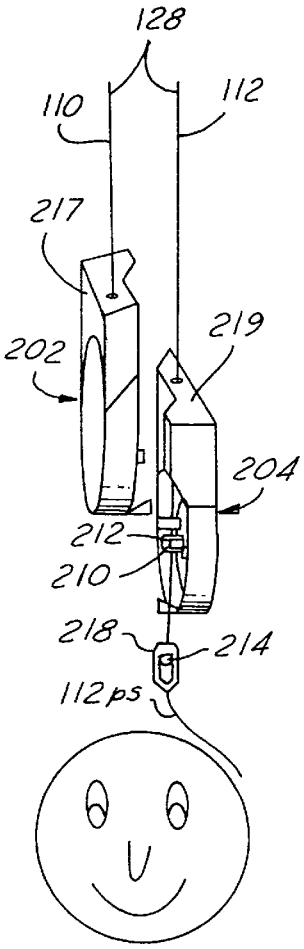

The problem illustrated in FIG. 1A also is solved with the addition of the ramp wedge 218 to the improved safety tassel 200. As shown in FIG. 7A, as loop 128 is being separated, post 212 and socket 210 are pulled apart as are ramps 206' and 208', and the ramp wedge 218 slides freely up the ramps 206' and 208' as shown in FIG. 7C. Note that there is no tension on cord 112ps under this condition. Eventually, pieces 202 and 204 are released and separate altogether, and then child head H is free from the tassel pieces, as shown in FIG. 7B.

First Embodiment Cord Slack Safety System

Figure 8A:
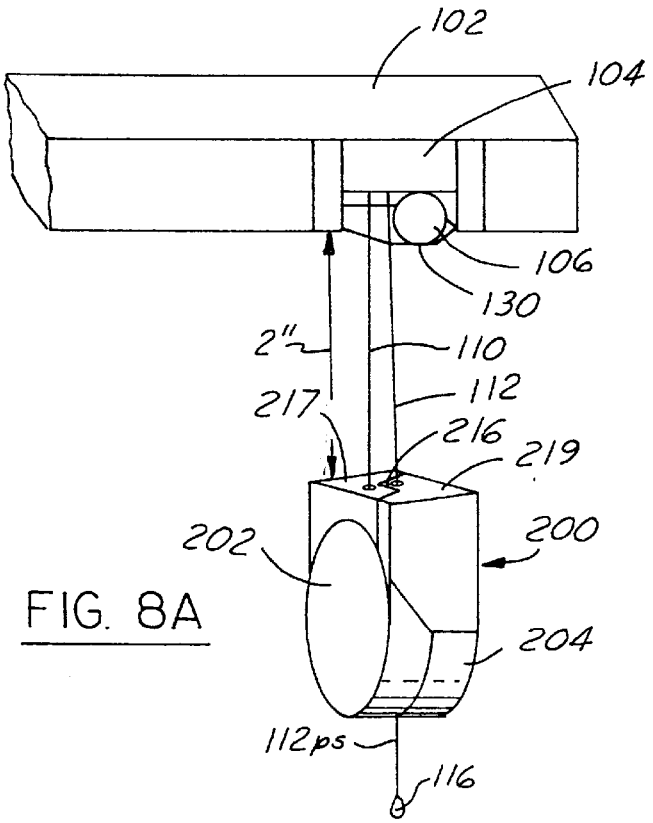
FIGS. 8A and 8B are simplified semi-diagrammatic views illustrating in sequence the operation of the first embodiment pull cord safety system of FIG. 3, utilizing the first or second embodiment safety tassels, when slack is taken up in the pull cord halyards by pulling one or both of the blind-entrained halyard runs from between the blinds.

FIG. 8A shows the preferred setting of the improved safety tassel 200 when the blind is completely lowered, namely about 2 inches below the conventional cord lock housing 104 in head rail 102.

Figure 8B:
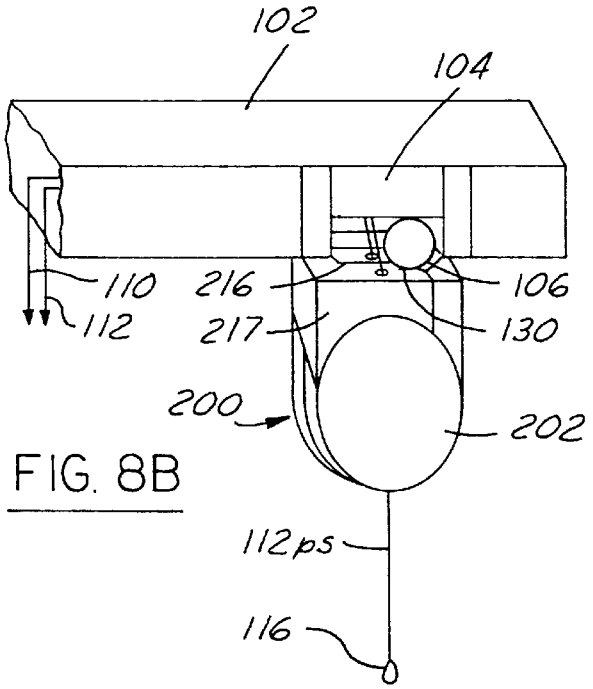

FIG. 8B shows the down runs of strings 110 and 112 slot-fed between the blind slats 118 (not shown) and the direction of pull force exerted on strings 110 and/or 112 when their slack is pulled out from between the slats 118.

In this system, when blind 100 is completely down and lock ball 106 is not latched, the improved safety tassel 200 as so located on cord strings 110 and 112 prevents the pull cord slack hazard in FIG. 2A. First, during installation tassel 200 is installed about 2 inches below head rail 102 when blind 100 is completely lowered and level in FIG. 8A. Now when a string or strings 110 and/or 112 are pulled through the slats 118 as shown in FIG. 2A, the zig zaged anti-separation joint 216 formed by top pieces 217 and 219 shown in FIGS. 4A–4D strikes the cord lock housing 104. The zig zaged top joint 216 of top pieces 217 and 219 as they press against the housing 104 does not allow the pieces 202 and 204 to be separated by the cord lock bar 130 shown in FIG. 8B because bar 130 tends to align with the plane of mating/separation of pieces 202 and 204 rather than joint 216, and the zig zag joint 216 between top pieces 217 and 219 transversely intersects bar 130 in any event. The first embodiment safety system thus allows only 2 inches of cord 110 and/or 112 to be pulled through the slats 118, thereby preventing the slack hazard of FIG. 2A.

Third Embodiment Safety Tassel

Figure 9:
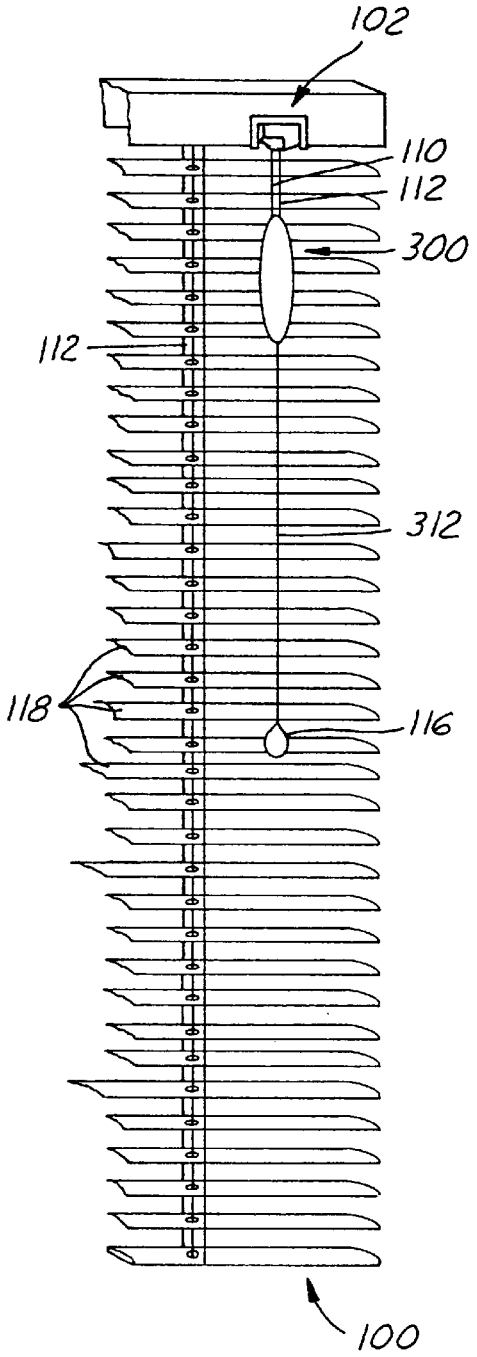
FIG. 9 is a view similar to FIG. 3 in which an improved third embodiment safety tassel of the invention is substituted in the first embodiment safety tassel pull cord and equalizer system of the invention.

FIG. 9 shows a break away tassel equalizer 300, which is another type of a single pull cord break away blind leveling device of the convention as used in the safety system of the invention. To level the blind 100 the equalizer 300 is installed 2 inches below the frame head rail 102 when the blind bottom rail 103 is completely lowered and level. The blind height of slats 118 is adjusted by the single lower pull cord 312 located and attached to the bottom center of tassel equalizer 300. An equal tension is applied via tassel 300 to the dual upper strings 110 and 112 when the pull cord 312 is pulled. This action forms a draw bar cord couple on the rigging of tassel equalizer 300, thereby ensuring a level blind pull while still preventing both of the hazards described in FIGS. 1A and 2A.

Figure 10A:
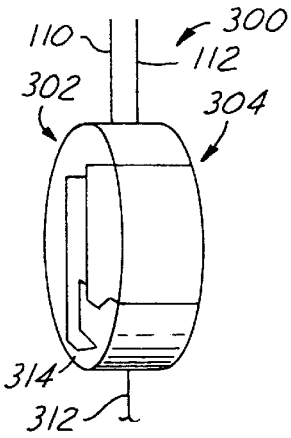
FIG. 10A is a simplified, semi-diagrammatic view of the third embodiment safety tassel in assembly with upper and lower pull cords attached thereto.
Figure 10B:
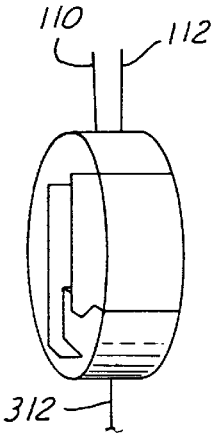
FIG. 10B is a view similar to FIG. 10A with the left hand side plate removed from the assembly.

Referring more particularly to FIGS. 10A–11C, the break away tassel equalizer 300 is made up of two different pieces, namely the wedge latch 302 and the cooperative wedge 304 both shown in assembly in FIG. 10A. The two pieces 302 and 304 are held together by the position of the strings 110 and 112 relative to assembled orientation of pieces 302 and 304. When the strings 110 and 112 are parallel to each other and pull tension applied thereto, either by pulling on the single lower cord 312 or on the equalizer itself, the break away equalizer 300 tends to be held together by these applied forces. Under these forces the flat top 316 is pressed up against the wedge latch ledge 322 while the wedge triangular bottom 320 is caught between the wedge latch pull string guard 310 and the wedge latch axis arch 306 shown in FIGS. 10B–10D and in FIGS. 11B and 11C. The pinch side walls 314 and 314' are added to wedge latch 302 to hold the pieces 302 and 304 together when the strings are wiggled, walls 314 and 314' thereby eliminating any slop movement of wedge 304 in wedge latch 302 by friction slip fit therebetween.

Figure 10C:
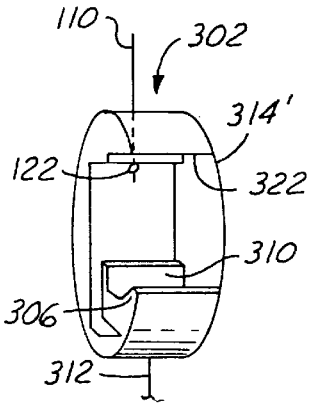
FIG. 10C is a perspective view similar to FIG. 10B but showing only the wedge latch part of the assembly by itself with the wedge part removed therefrom.
Figure 10D:
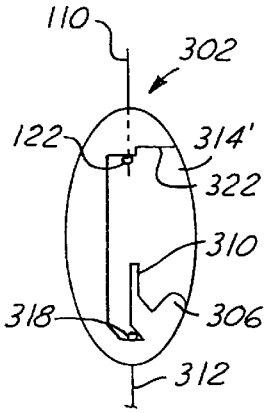
FIG. 10D is a side view of the wedge part shown in FIG. 10C, the left hand side plate having been removed from the showings in FIGS. 10C and 10D.
Figure 10E:
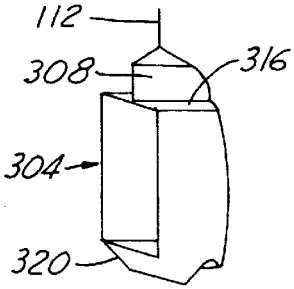
FIG. 10E is a simplified perspective view of the wedge part of the safety tassel assembly of FIGS. 10A and 10B.
Figure 10F:
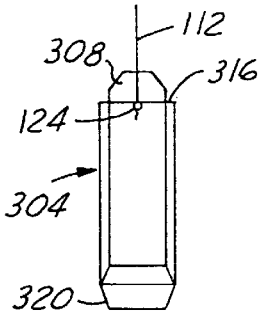
FIG. 10F is an elevational view of the wedge part of FIG. 10E.
Figure 10G:
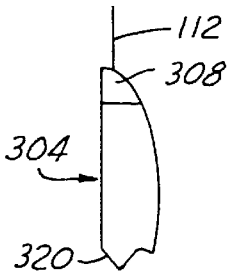
FIG. 10G is a side view of the wedge part of FIGS. 10E and 10F.

The break away equalizer 300 is held connected to the blind 100 via upper cords 110 and 112 by the leveling knots 122 and 124 in these respective cords, as shown in FIGS. 10C and 10F. The pull string 312 is held on by the pull string knot 312 (FIG. 10D) and the excess string from the knot 318 is guarded from interfering with the break away pivot motion of wedge 304 from wedge latch 302 by the wedge latch pull string guard 310 shown in FIGS. 10C and 10D.

Figure 11A:
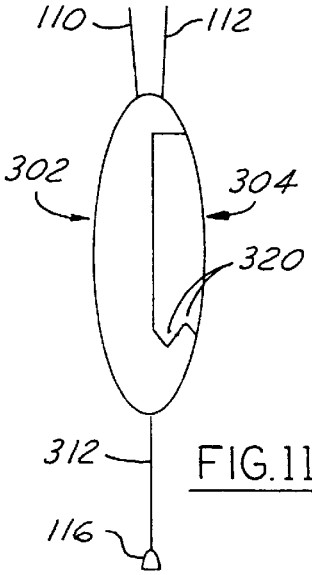
FIGS. 11A, 11B and 11C are semi-diagrammatic views illustrating in sequence the operation of the third embodiment safety tassel of FIGS. 10A–10G during break away safety operation.
Figure 11B:
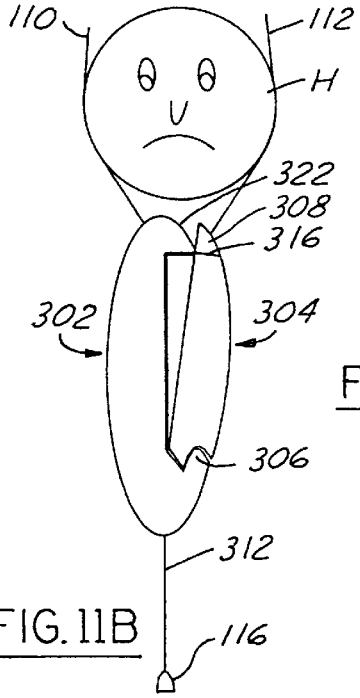
Figure 11C:
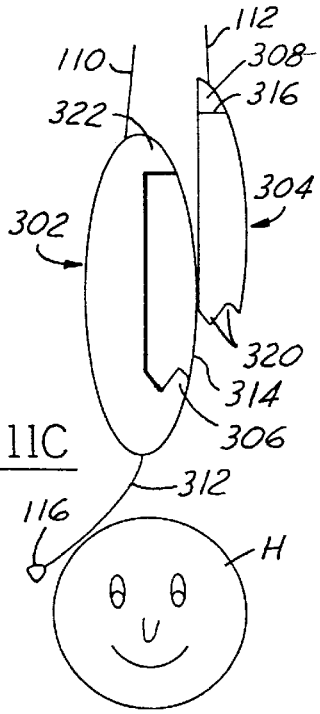

FIGS. 11A–11C show how the break away tassel equalizer 300 prevents the pull cord hazards in FIG. 1A. As the strings 110 and 112 are separated by the child head H (FIG. 11B), the direction of the tension forces in strings 110 and 112 are redirected in angled, opposing directions. Lower string 312 is slack at this time. The tension on string 112 applies a torque on the wedge 304 causing it to tilt away from its vertical latched position shown in FIG. 11A. FIG. 11B shows the triangular bottom groove 320 of wedge 304 rotating around (pivoting on) the wedge latch axis arch 306. This rotation or pivotal motion is just enough to free the wedge flat top 316 from beneath the wedge latch ledge 322, thereby separating pieces 302 and 304 and thus freeing the head H, as shown in FIG. 11C.

Figure 12A:
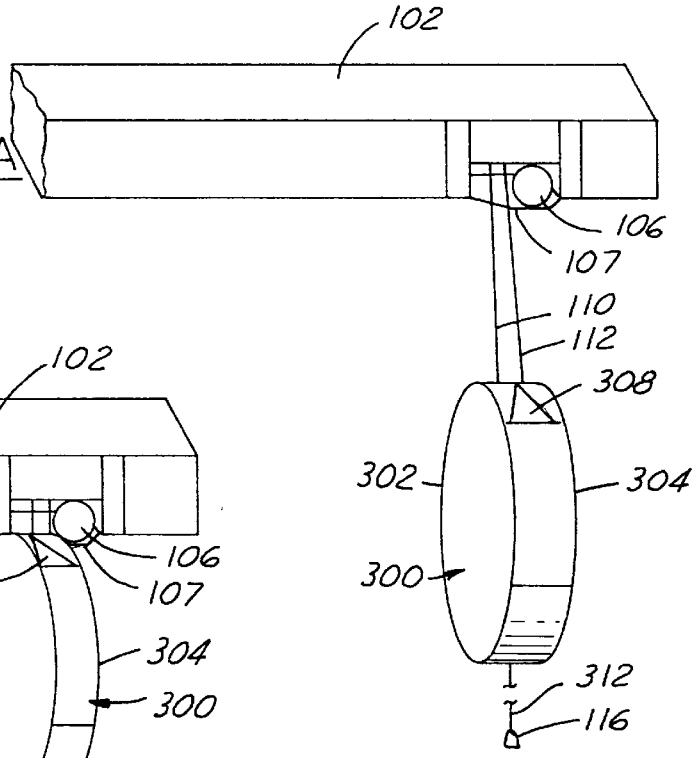
FIGS. 12A and 12B correspond to FIGS. 8A and 8B respectively, but illustrate the third embodiment safety tassel therein substituted for the first embodiment safety tassel.
Figure 12B:
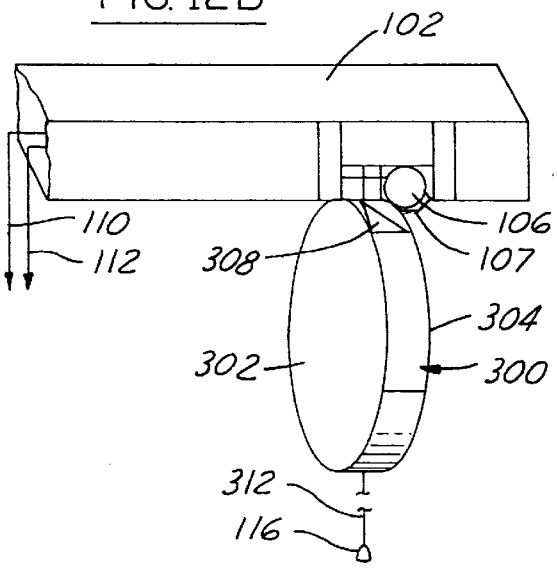

FIGS. 12A and 12B show how the break away tassel equalizer 300 prevents the pull string hazard from FIG. 2A. FIG. 12A shows the position of the break away equalizer 300 when the blind's bottom rail 103 is completely down. FIG. 12B shows the effect of the cord pull forces exerted when slack is pulled through the blind slats 118, as shown in FIG. 2A.

First, the equalizer 300 is installed about two inches below the frame head rail 102 when the blind bottom rail 103 is completely lowered and level. When either string 110 and/or 112 is pulled through the slats 118 in FIG. 2A, equalizer 300 is raised up into abutment with the head rail 102 as shown in FIG. 12B. The wedge pie stop 308 then strikes the cord lock bar 134 and thus operates as an anti-separation block, thereby preventing wedge 304 from rotating out of the wedge latch 304. The break away safety system so utilizing tassel equalizer 300 then leaves a harmless two inch loop of slack string 110 and/or 112 to be pulled through the slats 118, thereby preventing the cord slack problem of FIG. 2A.

Second Embodiment Safety System

Figure 13A:
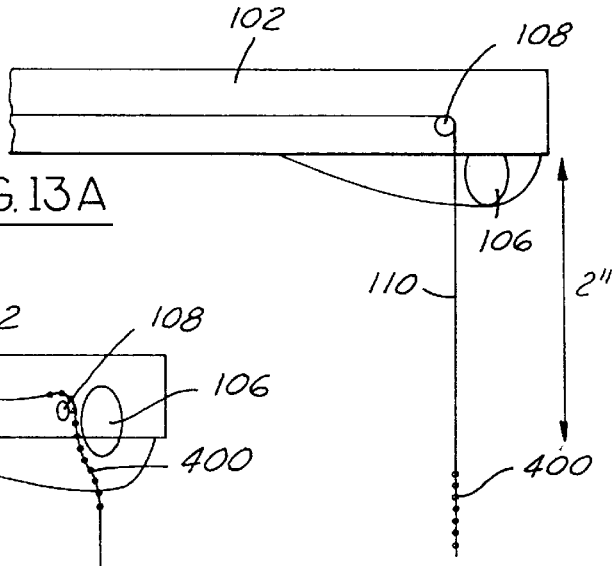
FIGS. 13A and 13B are semi-diagrammatic fragmentary views showing in sequence the construction and operation of the second embodiment of an improved safety pull cord system of the invention utilizing an improved fourth embodiment cord slack preventer.
Figure 13B:
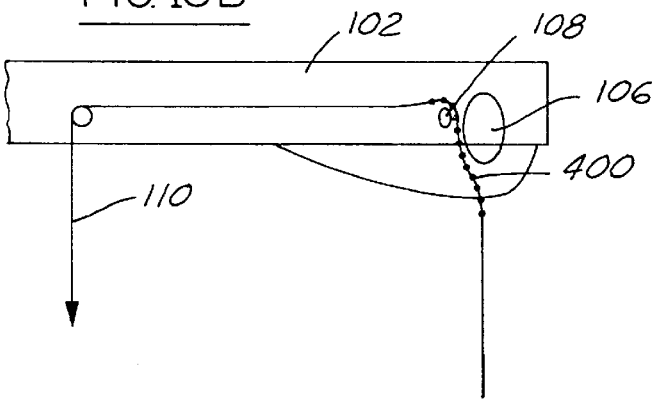

FIGS. 13A and 13B illustrate a universal cord slack preventer (U.C.S.P.) 400 of the invention that uses the blind frame cord lock ball 106 to latch either a single pull cord string 110, or any other number of single cord tasselled pull cord strings. Pulling the string 110 out of slats 118 as in FIG. 2A causes the preventer 400 to move up around the cord lock post 108 thereby raising up and latching the lock ball 106.

The preventer 400 as shown by way of example in FIGS. 13A and 13B is a series of ten knots tied on each string, as demonstrated on string 110 located about two inches below the head rail 102 when the bottom rail 103 is completely lowered. Preventer 400 may alternatively comprise any equivalent elongated flexible diametrical enlargement of string such as a flexible resilient thin tube of plastic material sleeved on string 110 and affixed thereto by adhesive, hot melt fusion, etc. The preventer 400 changes the flexibility of the string 110 enough to lift the cord lock ball 106 up and automatically latch it as the knots 400 rise over the cord lock post 108, yet the string 110 is still flexible enough to bend around the cord lock post 108 as shown in FIG. 13B. When the cord 110 is pulled back downwardly, preventer 400 will return to its normal straight position of FIG. 13A. Thus, by so providing preventer 400, now only two inches of string 110 can be pulled from between the slats 118, thereby again preventing the slack hazard in FIG. 2A. A preventer 400 also can be applied to each of dual pull cords that are both attached at their lower ends to a low level prior art safety tassel such as shown in FIGS. 2B–2D to thereby provide a complete safety system having break-away coupled pull cords.

Installation Template And Tassel/System Installation Procedures

Figure 14:
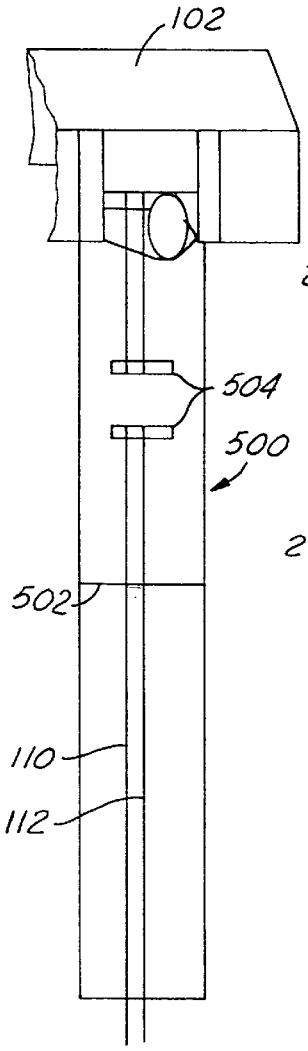
FIG. 14 is a fragmentary, semi-diagrammatic elevational view illustrating a system installation template provided in accordance with the invention and illustrating its use in the set up of the safety system.

FIG. 14 shows an installation template 500 of the invention that gives the user the ability to install any of the foregoing embodiments at ground level. The symbol "" in FIG. 14 indicates the distance between the top of the blind frame head rail 102 and the beginning of the knots 122 and 124 of cords 110 and 112 respectively. For the improved safety tassel 200 and the universal cord slack preventer 400, this distance should be about two inches. For the break away equalizer 300, this distance should be about 2¼ inches. The elevation of knots 122 and 124 or 400 will be at the installation mark line 502** when the blind is completely lowered.

Step 1] Remove tassels or tassel and cut the strings 110 and 112 at the bottom of the loop (if necessary).

Step 2] Lace the strings 110 and 112 through the template support slots 504 as shown in FIG. 14A.

Step 3] Adjust template 500 on strings 110 and 112 until template 500 hits the head rail 102 when the blind is completely down, as shown in FIG. 14A. This is the embodiment-installed position.

Step 4] Pull the cords 110 and 112 down, making sure template 500 is approximately in the same position relative to the cords 110 and 112. Level the blind (note: do not latch the cords 110 and 112) at a point where the template 500 and strings 110 and 112 can be grabbed.

Step 5] Mark the strings 110 and 112 on the installation mark line 502.

Installation of First Embodiment Safety Tassel 200 With Ramp Wedge Knot 214

Figure 15A:
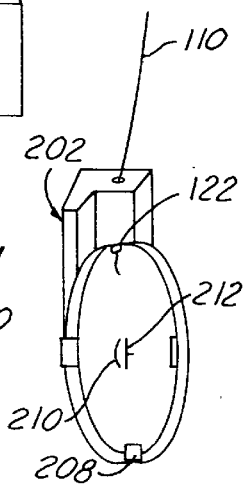
FIGS. 15A, 15B and 15C are semi-diagrammatic perspective views of the first embodiment safety tassel in sequential stages showing the installation of pull cords thereto.
Figure 15B:
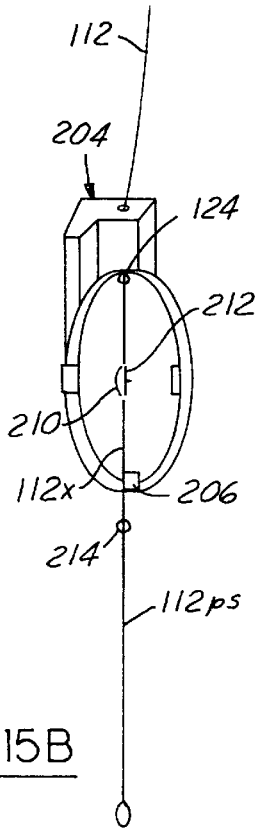

Step 6] Slide piece 202 past the marked line 502 on string 110. Tie a knot 122 on the marked line 502. Then cut the string 110, about ¼ inch below the level knot 122 shown in FIG. 15A.

Step 7] Slide piece 204 past the marked line 502 on string 112. Tie a knot 124 on the marked line 502. Next, tie another knot 112 ps, about 1¼ inches below the level knot 124. Then cut the pull string 112 ps to the desired length and install the tassel 116 shown in FIG. 15B.

Figure 15C:
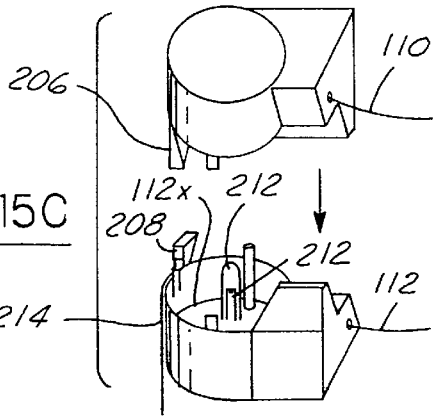

Step 8] Pack the pull string knot 214 and the pull string slack 112x into piece 204. Then place the post 212 and socket 210 of piece 202 into the post and socket 212 and 210 of piece 204. Finally, wiggle the pieces 202 and 204 until the pull string 112ps fits snug when the pieces 202 and 204 are to be closed as shown in FIG. 15C.

Installation of Second Embodiment Safety Tassel 200 With Ramp Wedge 218

Step 6] Repeat previous step 6.

Figure 16A:
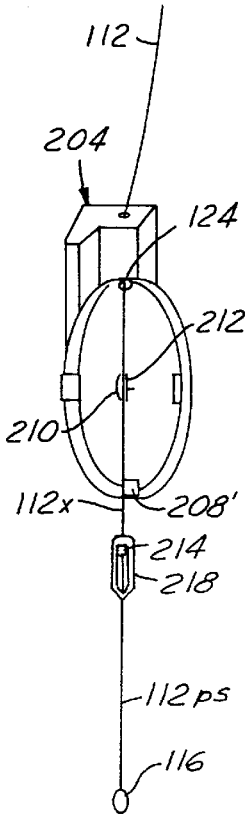
FIGS. 16A and 16B are sequential views showing corresponding installation steps for the second embodiment safety tassel.
Figure 16B:
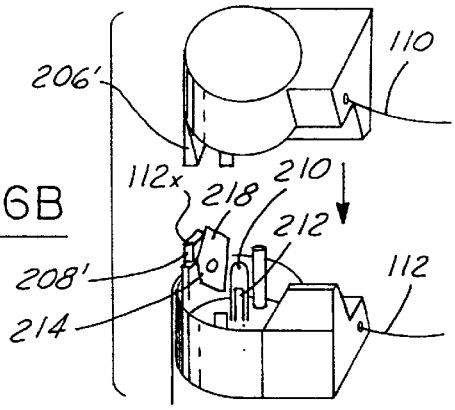

Step 7] Slide piece 204 past the marked line 502 on string 112 and tie a knot 124 on the marked line 502 shown in FIG. 16B.

Step 8] Slide the string 112 into the top half of the ramp wedge 218. Then tie a knot 214, about 1 ¼ inches down from the level knot 124. Next slide the string 112 ps through the bottom half of the ramp wedge 218 shown in FIG. 16B.

Step 9] Pack the pull string slack 112x and ramp wedge 218 into piece 204. Then place piece 202 over piece 204 connecting the post 212 and socket 210. Press the two pieces 202 and 204 together making sure the pull string 112 ps fits snug between the pieces 202 and 204 shown in FIG. 16C. Finally, cut the pull cord string 112ps to the desired length and install the single cord tassel 116.

Installation Of The Break Away Equalizer For Third Embodiment Safety Tassel 300

Step 6] Slide string 110 into the top of the wedge latch 302 past the marked line 502. Then tie the level knot 122. Cut the string ¼ inch below the knot 122 shown in FIG. 17A.

Figure 17A:
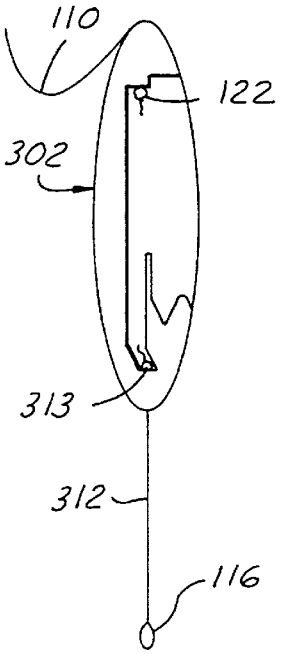
FIGS. 17A, 17B and 17C are sequential views of the third embodiment safety tassel parts illustrating cord installation steps in conjunction therewith.
Figure 17B:
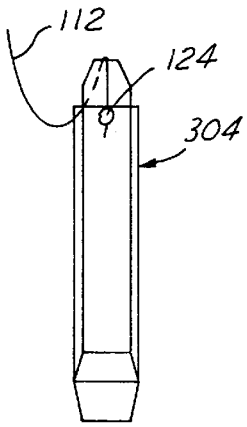

Step 7] Slide the pull string 312 into the bottom of the wedge latch 302 and tie a knot 313. Cut string 312, about ¼ inch above the knot 313. Pull the string back until the knot 313 sits at the bottom of the wedge latch 302 as shown in FIG. 17A. Cut the cord 312 to the desired length and install the tassel 116.

Figure 18A:
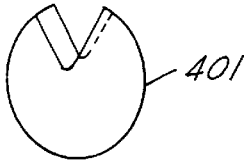
FIGS. 18A, 18B, 18C and 18D are semi-diagrammatic fragmentary views illustrating the construction of the fourth embodiment universal cord slack preventer of FIGS. 13A and 13B.
Figure 18C:
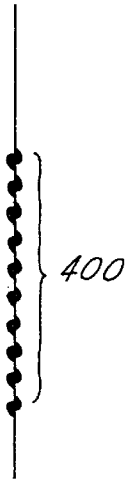
Figure 18B:
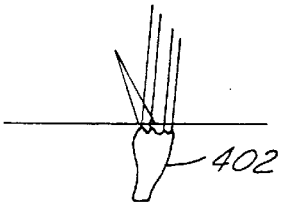
Figure 18D:
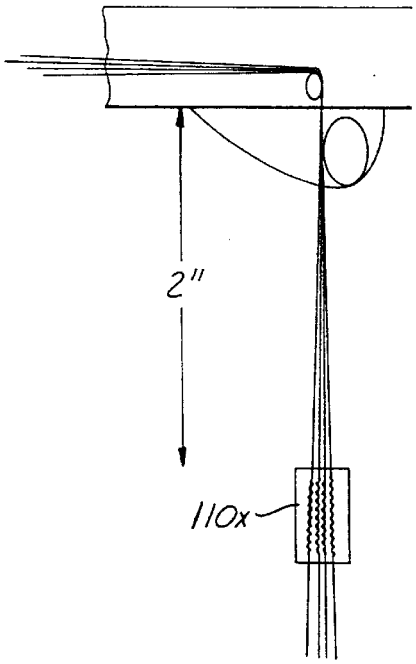
Figure 19A:
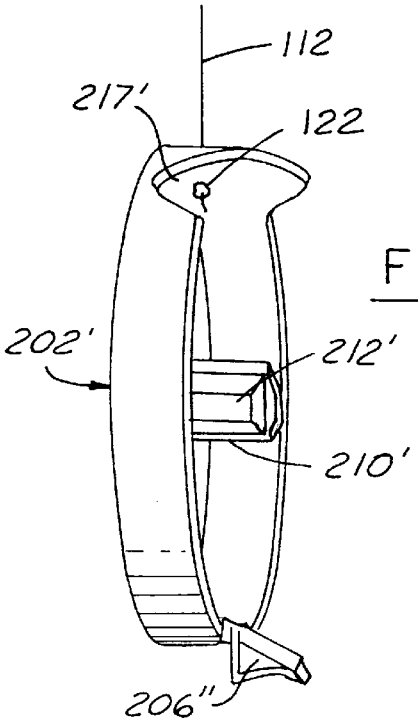
FIGS. 19A and 19B are respectively perspective angled and elevational views of one part of a fifth embodiment safety tassel of the invention, with an associated integrally molded ramp shown in its molded position.
Figure 19B:
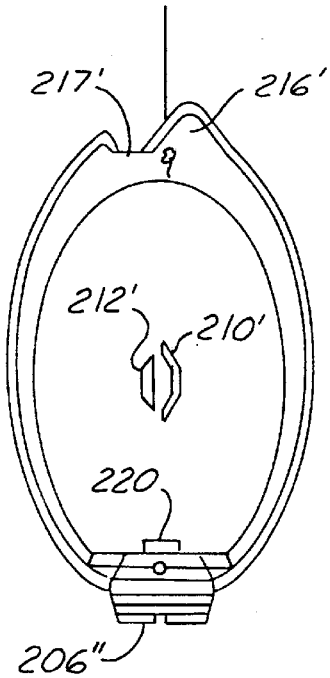
Figure 19C:
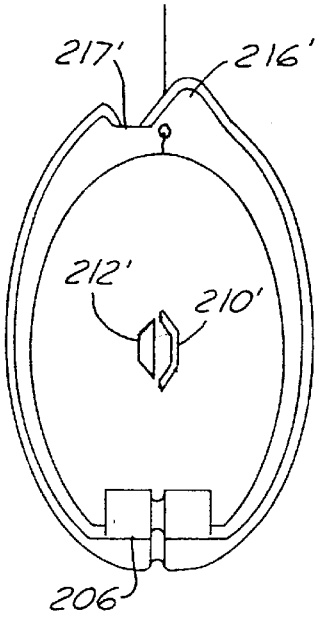
FIG. 19C is a view corresponding to FIG. 19B but showing the ramp folded up to its interior, in-use position in the associated tassel part.
Figure 19D:
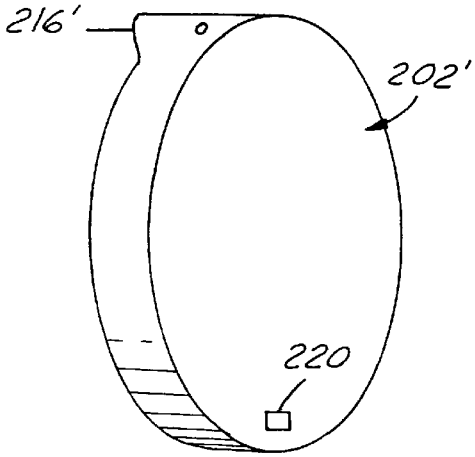
FIG. 19D is a perspective view of the exterior side of the part of FIGS. 19A–19C.
Figure 20A:
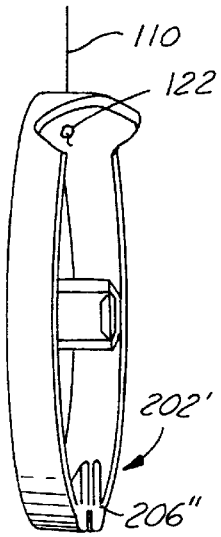
FIG. 20A is a perspective view of the tassel part of FIGS. 19A–19D with the ramp folded in as in FIG. 19C.
Figure 20B:
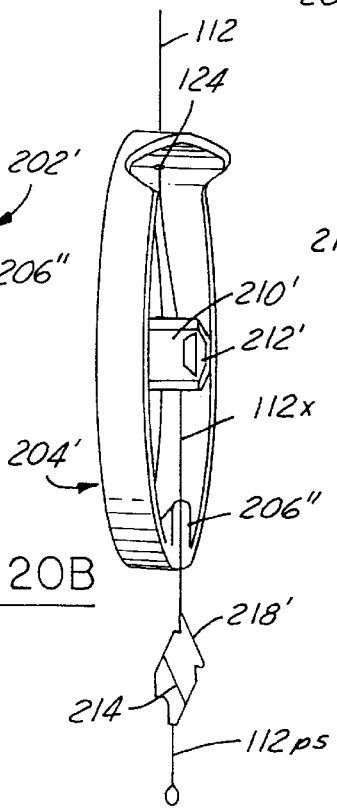
FIG. 20B is a view similar to FIG. 20A but showing the installation of the lower pull cord and associated ramp wedge piece thereon, as well as the tassel interior slack interconnector cord.
Figure 20C:
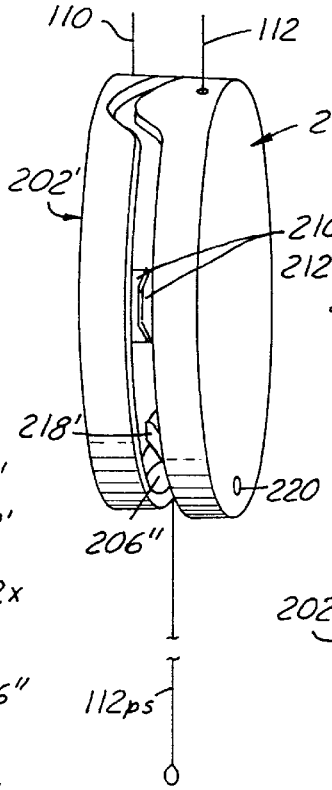
FIGS. 20C and 20D are perspective views respectively illustrating both parts of the tassel assembly of the fifth embodiment shown partially assembled and fully assembled.
Figure 20D:
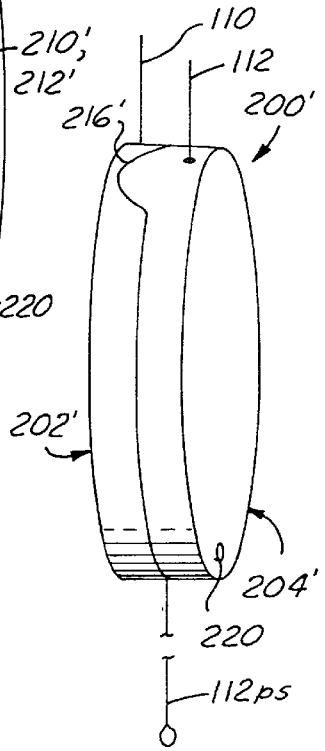

Step 8] Repeat step 4 for the wedge 304 and the level knot 124 as shown in FIG. 18B.

Figure 17C:
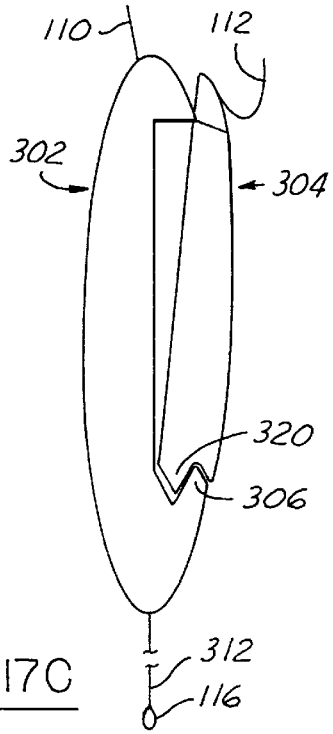

Step 9] Insert the triangular bottom 320 over the axis arch 306. Rotate the wedge 304 into the wedge latch 302 as shown in FIG. 17C.

Construction and Installation of Slack Preventer 400

Step 6] Tie a series of ten tightly packed knots 400 up against each other, then pull the string 110x with the preventer 400 in the middle. The end result is shown in FIG. 18C. Next, cut the pull cord string 110x to the desired length and install single cord tassel 116. FIG. 18B shows a method for packing the knots 400. The method uses a fork 402 to compress each knot 401, after it, is tied, when the string 110x is pulled through fork 402. FIG. 18A shows the type of knot 401 used.

Step 7] Repeat step 5 for each string 110x.

Fourth Embodiment Safety Tassel

FIGS. 19A–24 show another improved safety tassel 200' of the invention. This model uses one plastic mold that makes both sides of the equalizer pieces 202' and 204'. The ramp 206" is molded extending outward and then folded over for clipping into the clip slot 220 (FIG. 19D) which holds the ramps 206" and 208" in their inverted position shown in FIG. 19C.

On the top of the pieces 202' and 204' a sine wave pattern 216' is used to prevent the cord lock bar 130 (not shown) from splitting the seam (in the major plane of mating/separation) of the equalizer pieces 202' and 204'. This is done by the sine wave joint pattern keeping both pieces 202' and 204' on each side of the cord lock bar. Also, a small lip 217' sits under each half of the wave. This helps the pieces 202' and 204' stay together by pinching the pieces 202' and 204' together if tassel 200' strikes the headrail 102 (also not shown).

Note that the sine wave shape 216' and the lip 217' should not effect the intentional safety feature of breaking apart of pieces 202' and 204' in the case of an accident, the reason being the forces involved in pull cord hazards are different from slack cord hazards. To prevent cord slack hazards, the tension on strings 110 and 112 are greater in the vertical direction than in the horizontal when tassel 200' strikes the cord lock bar 130. These forces are applied to small surface areas between the lock cord bar 130, the head rail 102 and tassel 200'. This increases the Psi on the tassel 200' and the possibility of separating pieces 202 and 204. The sine wave joint 216' and portion 217' thus are made to stop such effect of this type of force and pressure.

On the other hand, if tassel 200' is separated by a child creating a pull cord hazard, the tension forces in the strings 110 and 112 are being redirected by the separation of the strings 110 and 112. Now the forces on strings 110 and 112 are greater in the horizontal direction ,and the PSI loads on tassel 200' are spread over a larger area with less unit force applied on the top of tassel 200'. The sine wave pattern 216' and the lip 217' cannot stop forces in this safety pull-apart direction with small surface pressures on tassel 200'.

Figure 21:
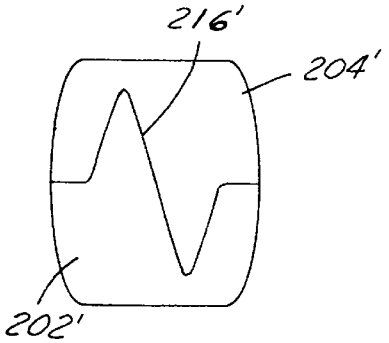
FIG. 21 is a fragmentary top plan view on an enlarged and exaggerated scale illustrating in assembly the anti-separation sine wave joint pattern in the mating abutment edges of the two pieces of the tassel of FIGS. 19A–20D.

FIG. 21 shows, on an exaggerated scale the sine wave shape on the top of tassel 200.

Figure 22:
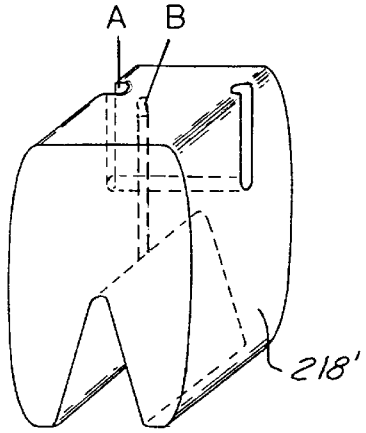
FIG. 22 is an enlarged and exaggerated perspective view showing the ramp wedge piece of the fifth embodiment tassel assembly by itself and greatly enlarged over the showing thereof in FIGS. 20B and 20C.

FIG. 22 shows (also on an exaggerated scale) the tooth wedge 218' that holds the pieces 202' and 204' together when the pull string 112ps is pulled. It is a single piece of plastic that has two holes in it. The reason for the side hole (A) is to tie the tooth wedge 218' onto string 112x with a single knot. The pull string knot 214, then the string 112ps, is placed through hole (B). This centers the pull string 112ps on the tooth wedge 218' when tassel 200' is assembled.

The improved safety tassel 200' embodiment has the ramps 206" and 208" butted together when the pieces 202' and 204' are closed fully together. Tassel 200' is normally held together by the post and socket assembly 210' and 212' when the pieces 202' and 204' are at rest, and by the tooth wedge 218' and ramps 206" and 208" when the blind is in motion. When pull string 112ps is pulled, tooth wedge 218' compresses ramps 206" and 208", thereby not allowing tassel 200' to be separated by the increased tension on each string 110, 112 that is created by the added weights of the slats of the blind.

On the other hand, when strings 110 and 112 are separated and there is no tension on pull string 112ps, tooth wedge 218' will freely shift upwardly as pieces 202' and 204' are being separated. However, note also that pieces 202' and 204' can still be broken apart when tension is being applied to the pull string 112ps because ramps 206" and 208" can rotate out of position when a small added torque is applied to pieces 202' and 204'.

Figure 23:
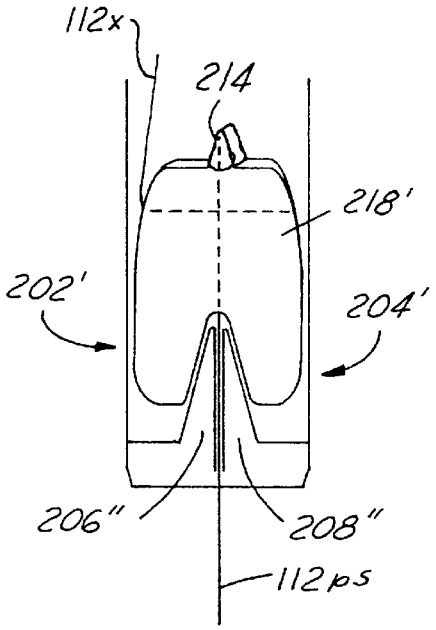
FIG. 23 is a fragmentary diagrammatic and exaggerated cross-sectional view illustrating the two tassel pieces in assembly and the ramp wedge normally positioned in assembly of the tassel in the condition of FIG. 20D.
Figure 24:
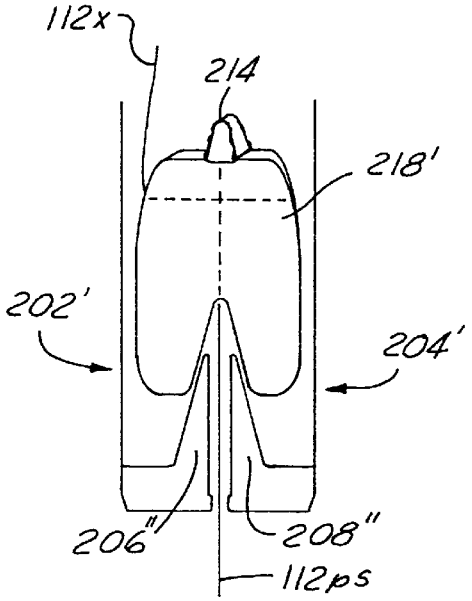
FIG. 24 is a view similar to FIG. 23 but showing the position of the ramp wedge piece and the ramps when partially separated corresponding to the condition of FIG. 20C.

FIGS. 23 and 24 illustrate how tooth wedge 218" compresses and separates from ramps 206" and 208". Note that in practice shallow ramp angles are preferred, say on the order of only about 10°–20°. The installation of tassel 200' is similar to that of modified tassel 200 except that pieces 202' and 204' are easier to put together because only the post and socket 210' and 212' are connected together. FIGS.

20A–20D show pieces 202' and 204' assembled on the blind strings 110 and 112.

Multiple Safety Tassel Systems

Figure 25:
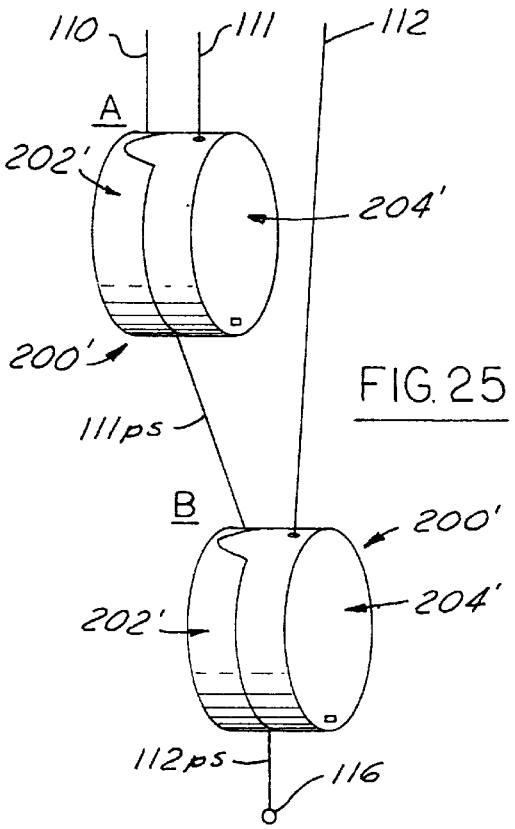
FIG. 25 is a diagrammatic perspective view of a three pull cord safety tassel rigging arrangement in accordance with the invention and utilizing two of the safety tassels of the fifth embodiment of FIGS. 19A–24.

FIG. 25 illustrates an example of a pull cord/safety tassel rigging arrangement of the invention that may be employed for a horizontal venetian blind assembly utilizing three pull cords for a three halyard hoist rigging. This multiple tassel system employs, by way of example, two of the fourth embodiment safety tassels 200' arranged as shown in FIG. 25 as upper and lower tassels A and B Upper tassel A has piece 202' connected to the left hand pull cord 110 and piece 204' connected to the middle pull cord 111 in the manner of the previously described dual cord systems. Tassel B is arranged below tassel A and piece 202' of tassel B has its upper pull string connected as the single down pull strong 111ps of tassel A. Part 204' of tassel B is connected to the right hand pull string 112 of the three cord pull string rigging array. Tassel B thus becomes the safety decoupler for upper cords 111 and 112. The down pull single string 112ps connected to tassel B becomes the primary single pull cord operating element of this three-cord rigging array for raising and lowering the blinds, and has the single cord one piece tassel 116 affixed to its lower end for this purpose.

Figure 26:
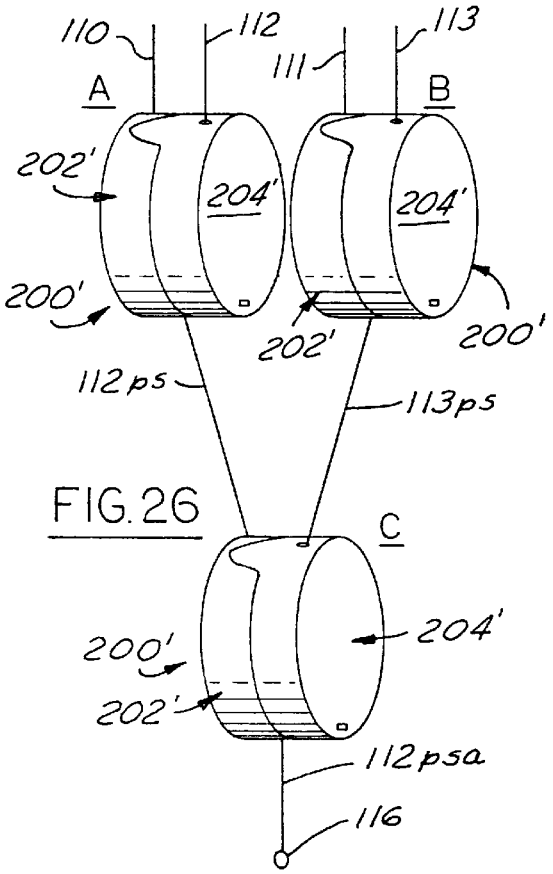
FIG. 26 is a diagrammatic perspective view of four pull cord array rigging arrangement of the invention utilizing three of the fifth embodiment safety tassels.

FIG. 26 illustrates a three tassel system of the invention rigged for operating a horizontal venetian blind having a four halyard rigging hoist. Two tassels 200' are arranged side by side as upper tassels A and B. Tassel A has two mutually adjacent upper cords 110 and 112 of the four cord rigging connected thereto in the manner of a two cord system for safety decoupling cords 110 and 112. Likewise, tassel B has the other two mutually adjacent upper cords 111 and 113 of the four cord system attached thereto, likewise in the manner of a two cord system for safety decoupling cords 111 and 113. The single lower pull strings 112ps and 113ps extending respectively downwardly from tassels A and B are connected in the manner of two upper pull strings to the third and lower tassel C, which then becomes the safety decoupler for cords 112ps and 113ps. A single lower pull string 112psa extending downwardly from lower tassel C then becomes the primary single pull cord for operating the four cord system, the one piece pull tassel 116 being attached to the lower end of cord 112psa for this purpose.

It will be seen that a sidewise separating force generated between any two mutually adjacent cords of either the three cord system or the four cord system will cause separation of such cords and decoupling of the potential strangulation coupling loops attached to the tassels, in the manner described previously with the single tassel, two cord break apart safety systems of the invention.

Design Considerations For Safety Tassel Embodiment

1. Piece Safety

Consideration should be given to the possibility of a piece of the tassel being placed in the mouth, sometimes resulting in the child choking on the tassel piece. All of the equalizer embodiments will prevent his in three ways. First, the pieces will be harder to reach because of the positioning of the embodiment on the blind. Second, the knots are tightened each time the pull cord is pulled, eliminating the possibility of the knots loosening after long periods of time, freeing the pieces. The third being the pieces are large enough not to swallow. The third part separates the embodiments in this category.

A) When making the first embodiment tassel, consideration must be taken into account for the ramps 206 and 208 zig zag top 216, 217 and 219. These parts cannot get caught in the mouth when the cord is unlatched.

B) The same considerations must be taken into account for the second embodiment tassel.

C) The third embodiment tassel has to be made long enough to prevent swallowing. Its rectangular shape is harmless to the mouth and the triangular bottom 320 can be flattened and rounded to make it safe.

2. Embodiment Considerations

This refers to some considerations to be taken into account when designing each embodiment.

A) Ramps 206 and 208 must be made large enough so the pull string knot 214 will sit between ramps 206 and 208, to create the compressing torque to keep the pieces together when being pulled. The pieces must also be made large enough not to swallow or get hooked in the mouth. Also, the zig zag top 216, 217 and 219 must be wide and long enough to hit the head rail 102 to prevent the lock ball support bar 130 from separating the pieces if the cord is pulled from the slats 118.

B) Ramp wedge 218 attached to the pull string 112ps to hold the pieces together must be made large enough to install by hand and fit over the pull string knot 214. Also, an increased area is needed between the post and socket assembly 210 and 212 and the ramps 206' and 208" for the ramp wedge 218 to slide up the ramps 206' and 208' when the pieces are separated. As a result, post and socket 210 and 212 can be moved out of the center of the pieces or the pieces are made longer. The above piece swallowing and the zig zag top 216 considerations also apply. The problem of the pull string 312 interfering with the break-away action can be avoided using the pull string guard 310, or hollowing out the wedge latch 302 and putting the wedge pattern on the pinch walls 314 and lowering the bottom of the wedge latch 302 so string 312 cannot interfere. Doing this reduces the area that string 312 can get caught. Another consideration, at a constant flat top 316 length from back to front, the longer the wedge 304 is made on the tighter the fit can be made between the wedge latch 302 and the wedge 304. The reason for this is the angular exit displacement is decreased between the wedge 304 and wedge latch 302.

Summary of Advantages

The loop of the dual pull cord is placed where it is out of reach, even for most adults, i.e., at the top of the blind when the blind is completely lowered to its desired in-use lowermost condition, thereby allowing only a safe single pull cord to be accessible within convenient reach to be pulled by the user. The advantages of this, first, only the safe single pull cord hangs from the break-away equalizer, and it also assures a level blind raising and lowering effect. This means the user can either do one of two things: (1) so install the dual (or triple or quadruple) pull cord and adjust the length of the single pull cord to the minimum size required by the adult to pull the cord, while also preventing excess pull cords from being in reach of the child; (2) the single pull cord can be omitted from the break-away equalizer in cases where such a pull cord is not required. Another advantage is the loop of the pull cord is installed at the top of the blind, thereby reducing the threat of choking in two ways: (1) the loop of the blind is out of reach of the child unless it is pulled down to the child's level, in which case it will break apart if tampered with; also, if an adult chooses to place the excess pull cord out of reach of the child there is less cord to deal with; (2) by installing the break-away equalizer at the top of the blind the slack string hazard is also eliminated.

I claim:

1. A safety pull cord system for use with window coverings for raising, lowering and equalizing such coverings and having a first cord having first and second opposite ends and constructed at the first end for attachment to the window covering, a second cord having first and second opposite ends and constructed at the first end for attachment to the window covering, a first equalizer tassel member retained by the first cord via first cord attachment means at the second end of the first cord, a second equalizer tassel member retained by the second cord via second cord attachment means at the second end of the second cord, and means for detachably coupling the first and second tassel members to each other in a side-by-side assembled relationship providing for a break-open complete uncoupling of said members so as to be bodily free and completely separated from each other upon the exertion of a sidewise separation force against said first and second members at positions between said first and second cords developed by spreading apart of said cords and applied by said cords to said members in the vicinity of said second cord ends, a third cord having first and second opposite ends, and third cord attachment means operably coupling said third cord first end to said members for suspending said third cord downwardly from at least one of said members in use to apply a downward pull force on said first and second cords via at least one of said members, said third cord being adapted at said second end thereof for application of such downward pull force, said cord attachment means being constructed and arranged such that said first and second members remain operably coupled respectively to said first and second cords, and said third cord remains suspended from one of said first and second cords after said break-open complete uncoupling of said members.

2. The combination as set forth in claim 1 wherein said members are shaped to facilitate their gripping in the palm of a hand when a downward force is to be applied to the cords to adjust the vertical position of the window covering.

3. The combination as set forth in claim 2 wherein said first and second members are hollow to facilitate the retention of said members by said cords at internal positions within said members.

4. The combination set forth in claim 3 wherein said members abut one another in a detachably coupled assembly at an abutment plane of mating and separation oriented in use vertically to thereby form a complete pull tassel, and wherein said first and second cord ends are connected respectively to said first and second members respectively via said first and second cord attachment means located closely adjacent to but respectively on opposite sides of said separation plane, and wherein said third cord attachment means is also located closely adjacent said separation plane at a position spaced downwardly in use from said first end second cord second ends.

5. The combination set forth in claim 4 wherein said detachable coupling means of said members is located generally adjacent said separation plane and generally between said said first and second cord attachment means and said third cord attachment means.

6. The combination set forth in claim 5 wherein said third cord attachment means is directly connected solely to one of said members and remains attached thereto upon separation of said members.

7. The combination set forth in claim 5 wherein said third cord attachment means is operable to connect said third cord first end to both of said members when in detachably coupled assembly and is operable to disconnect said third cord first end from at least one of said members upon separation of said members.

8. The combination set forth in claim 7 wherein said third cord first end is operably permanently connected to one of said first and second cords by a flexible tension element encapsulated between said members when in detachably coupled assembly thereof.

9. The combination set forth in claim 7 wherein said third cord attachment means comprises first and second ramps respectively connected to said first and second members and each having an inclined surface oriented at acute angle relative to said separation plane and inclined reversely relative to one another, and wedge means connected to said third cord first end, said ramps and said wedge means being constructed and arranged such that when said wedge means bears on both of said ramps inclined surfaces in response to pull tension force being applied to said third cord between said ends thereof, said ramps develop a component of said pull force tending to force said members toward coupled abutment.

10. The combination set forth in claim 9 wherein said ramps are arrayed side-by-side and said ramp surfaces extend on both sides of said separation plane, and wherein said wedge means bears on said ramp surfaces in cradled relation thereon in alignment with the concave intersection of an imaginary extension of the planes of said ramp surfaces.

11. The combination set forth in claim 10 wherein said wedge means comprises a knot in said third cord first end.

12. The combination set forth in claim 10 wherein said wedge means comprises a wedge member connected to said third cord first end and having inclined surfaces complemental to and cooperable with said ramp surfaces to develop said force component.

13. The combination set forth in claim 12 wherein said wedge member is operably permanently connected to one of said first and second cords by a flexible tension element encapsulated between said members in coupled assembly thereof.

14. The combination set forth in claim 9 wherein said ramps are constructed and arranged to mutually oppose one another in coupled assembly of said members such that said ramp surfaces each terminate generally at said separation plane and together define an upwardly oriented conjoint ramp apex in use, and wherein said wedge means comprises a wedge member connected to said third cord first end and having inclined camming surfaces defining a concavity complemental to and cooperable with said ramp surfaces to develop said force component.

15. The combination set forth in claim 14 wherein said wedge member is operably permanently connected to one of said first and second cords by a flexible tension element encapsulated between said members in coupled assembly thereof.

16. The combination set forth in claim 4 wherein said members are provided with anti-separation means constructed and arranged in a zone of said members in the vicinity of the retention of said first and second cord second ends with said members and operable to resist or prevent development of separational forces acting on said members transverse to said separation plane when an object is forced directly against said members in said zone.

17. The combination set forth in claim 16 wherein said anti-separation means comprises mating edges of said members extending in said zone in a wave pattern having excursions extending across said separation plane.

18. The combination set forth in claim 16 wherein said anti-separation means comprises a pair of abutment blocks one mounted on each of said members in said cord zone and meeting in an abutment joint having a block separation plane of zig-zag formation and intersecting said plane of separation of said members.

19. The combination set forth in claim 16 wherein said anti-separation means comprises at least one abutment protrusion disposed on one of said members in said zone and overlapping an end of the other of said members closest to said zone such that said other member is generally isolated by said protrusion from impingement by the object.

20. The combination set forth in claim 1 wherein said members include abutment means provided on said members and shaped at their in-use upper ends to resist detachment between said members upon exertion of a downward force exerted by an object impinging both of said members at a position between said cords and when the object impingement force is concentrated generally in a plane coincident with said plane of separation of said members.

21. The combination set forth in claim 2 wherein said first member comprises a wedge latch body elongated in the vertical direction when oriented in use and having a side-opening cavity formed therein, and wherein said second member comprises a wedge body configured to be bodily received in and bodily completely released from said cavity when said members are respectively detachably coupled and uncoupled, and with a ledge portion of said wedge latch body overlapping the in-use upper end of said wedge body when received in said cavity.

22. The combination set forth in claim 21 wherein said bodies have cooperative interengageable detachable pivot means positioned at the in-use lower end of said cavity for pivotally supporting the lower end of said wedge body on said wedge latch body for initial separational swinging movement thereof in a plane perpendicular to said separation plane of said members.

23. The combination set forth in claim 22 wherein said bodies have mutually engageable frictional retaining surfaces generally perpendicular to said separation plane for releasably holding said members coupled in assembly when said wedge body is fully received in said wedge latch body cavity.

24. The combination set forth in claim 23 wherein said third cord first end is connected to the in-use lower end of said wedge latch body.

25. The combination set forth in claim 24 wherein said ledge portion has a side-opening notch also opening to said cavity, and the in-use upper end of said wedge body has a wedge enterable into said notch to facilitate alignment of said bodies as said wedge body is pivoted into filly inserted position in said cavity, one of said cord second ends being connected via one of said first and second cord attachment means to said wedge of said wedge body and the other of said cord second ends being connected via the other one of said first and second cord attachment means to said ledge, said wedge also serving as an anti-separation abutment to keep said wedge body restrained in said cavity when said bodies are hoisted into abutment with a frame rail latch ball mechanism.

26. The combination set forth in claim 1 in further combination with a horizontal venetian blind in which each of said cords have a down-hanging run terminating at said cord second ends and which passes upwardly through a cord lock in a frame of the said blind at the top of said blind, each of said cords having a horizontal run within said frame that exits said frame and continues on as in-blind run extending downwardly to a connection of each of said cord first ends with a bottom bar of said blind, said blind bottom bar being raised and lowered by manually pulling in and paying out said downhanging cord runs and wherein said blind bottom bar is held suspended in a desired fully lowered condition of said blind as by hanger cords fixed at their opposite ends to said frame and bottom bar or by resting on a sill or other support, said tassel members being connected to said cord second ends closely adjacent said blind frame in the desired fully lowered condition of the blind.

27. A horizontal venetian blind safety rigging system wherein a plurality of halyards for the horizontal slats of the blind are rigged such that, when the blind is fully lowered to a desired window covering position, an insufficient amount of slack remains in the blind-internal slat-fed runs of the halyards to enable the same to be pulled out from between the blind slats to form a potential strangulation noose, the blind-free manipulating runs of the halyards having halyard travel stop means thereon adapted to engage the frame rail halyard lock mechanism or associated blind frame rail in such blind fully lowered condition to thereby limit such halyard slack to such insufficient amount, said travel stop means comprising break-open safety tassel means operable detachably safety intercoupling the blind-free halyard manipulating runs, said tassel means being provided with anti-separation means operable to prevent break-open of said tassel means upon halyard travel stop engagement of said tassel means with such lock mechanism or frame rail.

28. The system of claim 27 wherein said travel stop means comprises reak-open safety tassel means operable detachably safety intercoupling the blind-free halyard manipulating runs.

29. The system of claim 27 wherein said tassel means has a simple pull cord dependent therefrom for operating the hoisting halyards.

30. For use in a horizontal venetian blind assembly, a pull cord rigging array comprising three hoisting halyards with individually associated first, second, and third manipulating runs, and safety tassel means comprising an array of two separate first and second break-open safety tassels each having first and second mutually break-open separable primary components, said first and second halyard manipulating runs being mutually adjacent and detachably intercoupled by connections respectively to said first and second components of said first tassel, said third run being adjacent said second run and on the side thereof remote from said first run, said third run being connected to said second component of said second tassel a flexible tension element connecting said second tassel first component to at least one of said components of said first tassel such that said second tassel is suspended below said first tassel by said third run and by said flexible tension element, said third run and said flexible element being detachably intercoupled by said second tassel, and a single pull cord suspended from a connection to said second tassel.

31. For use in a horizontal venetian blind assembly, a pull cord rigging array comprising four hoisting halyards with individually associated first, second, third and fourth manipulating runs, and safety tassel means comprising an array of three separate first, second and third break-open safety tassels each having first and second mutually break-open separable components, said first and second runs being arrayed adjacent one another and connected respectively to said first tassel first and second components, said third and fourth runs being arrayed adjacent one another and connected respectively to said second tassel first and second components, said first and second tassels being arrayed generally side-by-side and said third tassel spaced therebelow and suspended therefrom by first and second flexible tension elements connected respectively each at an upper end to said first and second tassels and connected respectively each at a lower end to said third tassel first and second components, and a single pull cord suspended from a connection to said third tassel.

32. A horizontal venetian blind safety rigging system wherein a plurality of halyards for the horizontal slats of the blind are rigged such that, when the blind is fully lowered to a desired window covering position, an insufficient amount of slack remains in the blind-internal slat-fed runs of the halyards to enable the same to be pulled out from between the blind slats to form a potential strangulation noose, the blind-free manipulating runs of the halyards having halyard travel stop means thereon adapted to engage the frame rail halyard lock mechanism or associated blind frame rail in such blind fully lowered condition to thereby limit such halyard slack to such insufficient amount, said travel stop means comprising limiter means forming a flexible enlargement of each of the plural blind-free halyard manipulating runs and suitably diametrically and longitudinally sized to operably engage the frame rail lock mechanism and thereby cause releasable entrained lock-up therein of said limiter means.

33. The system of claim 32 wherein said limiter means comprises a row of knots formed in the associated halyard manipulating run.

34. A horizontal venetian blind safety rigging system wherein a plurality of halyards for the horizontal slats of the blind are rigged such that, when the blind is fully lowered to a desired window covering position, an insufficient amount of slack remains in the blind-internal slat-fed runs of the halyards to enable the same to be pulled out from between the blind slats to form a potential strangulation noose, the blind-free manipulating runs of the halyards having halyard travel stop means thereon adapted to engage the frame rail halyard lock mechanism or associated blind frame rail in such blind fully lowered condition to thereby limit such halyard slack to such insufficient amount, said travel stop means comprising break-open safety tassel means operable detachably safety intercoupling the blind-free halyard manipulating runs, said tassel means having a simple pull cord dependent therefrom for operating the hoisting halyards, and wherein said plurality of hoisting halyards are three in number with individually associated first, second, and third manipulating runs, and said safety tassel means comprising an array of two separate first and second break-open safety tassels each having first and second mutually separable primary components, said first and second halyard manipulating runs being mutually adjacent and detachably intercoupled by connections respectively to said first and second components of said first tassel, said third run being adapt said second run and on the side thereof remote from said first run, said third run being connected to said second component of said second tassel a flexible tension element connecting said second tassel first component to at least one of said components of said first tassel such that said second tassel is suspended below said first tassel by said third run and by said flexible tension element, said third run and said flexible element being detachably intercoupled by said second tassel, said single pull cord being suspended from a connection to said second tassel.

35. A horizontal venetian blind safety rigging system wherein a plurality of halyards for the horizontal slats of the blind are rigged such that, when the blind is fully lowered to a desired window covering position, an insufficient amount of slack remains in the blind-internal slat-fed runs of the halyards to enable the same to be pulled out from between the blind slats to form a potential strangulation noose, the blind-free manipulating runs of the halyards having halyard travel stop means thereon adapted to engage the frame rail halyard lock mechanism or associated blind frame rail in such blind fully lowered condition to thereby limit such halyard slack to such insufficient amount, said travel stop means comprising break-open safety tassel means operable detachably safety intercoupling the blind-free halyard manipulating runs, said tassel means having a simple pull cord dependent therefrom for operating the hoisting halyards, said wherein said plurality of hoisting halyards are four in number with individually associated first, second, third and fourth manipulating runs, and said safety tassel means comprising an array of three separate first, second and third break-open safety tassels each having first and second mutually separable components, said first and second runs being arrayed adjacent one another and connected respectively to said first tassel first and second components, said third and fourth runs being arrayed adjacent one another and connected respectively to said second tassel first and second components, said first and second tassels being arrayed generally side-by-side, and said third tassel spaced therebelow and suspended therefrom by first and second flexible tension elements connected respectively each at an upper end to said first and second tassels and connected respectively each at a lower end to said third tassel first and second components, said single pull cord being suspended from a connection to said third tassel.

36. A safety pull cord system for use with window coverings for raising, lowering and equalizing such coverings and having a first cord having first and second opposite ends and constructed at the first end for attachment to the window covering, a second cord having first and second opposite ends and constructed at the first end for attachment to the window covering, a first equalizer tassel member retained by the first cord via first cord attachment means at the second end of the first cord, a second equalizer tassel member retained by the second cord via second cord attachment means at the second end of the second cord, and means for detachably coupling the first and second tassel members to each other in a side-by-side assembled relationship providing for a break-open complete uncoupling of said members so as to be bodily free and completely separated from each other upon the exertion of a sidewise separation force against said first and second members at positions between said first and second cords developed by spreading apart of said cords and applied by said cords to said members in the vicinity of said second cord ends, said cord attachement means being constructed and arranged such that said first and second members remain operably coupled respectively to said first and second cords after said break-open complete uncoupling of said memebers, said members being shaped to facilitate their gripping in the palm of a hand when a downward force is to be applied to the cords to adjust the vertical position of the window covering, said first memeber comprising a wedge latch body elongated in the vertical direction when oriented in use and having a side-opening cavity formed therein, and said second member comprising a wedge body configured to be bodily received in and bodily completely released from said cavity when said members are respectively detachably coupled and uncoupled, and with a ledge portion of said wedge latch body overlapping the in-use upper end of said wedge when received in said cavity.

37. The combination set forth in claim 36 wherein said bodies have cooperative interengageable detachable pivot means positioned at the in-use lower end of said cavity for pivotally supporting the lower end of said wedge body on said wedge latch body for initial separational swinging movement thereof in a plane perpendicular to said separation plane of said members.

38. The combination set forth in claim 37 wherein said bodies have mutually engageable frictional retaining surfaces generally perpendicular to said separation plane for releasably holding said members coupled in assembly when said wedge body is fully received in said wedge latch body cavity.

39. The combination set forth in claim 38 wherein said ledge portion has a side-opening notch also opening to said cavity, and the in-use upper end of said wedge body has a wedge enterable into said notch to facilitate alignment of said bodies as said wedge body is pivoted into fully inserted position in said cavity, one of said cord second ends being connected via one of said first and second cord attachment means to said wedge of said wedge body and the other of said cord second ends being connected via the other one of said first and second cord attachment means to said ledge, said wedge also serving as an anti-separation abutment to keep said wedge body restrained in said cavity when said bodies are hoisted into abutment with a frame rail latch ball mechanism.

* * * * *